US009005694B2

(12) United States Patent
Popa et al.

(10) Patent No.: US 9,005,694 B2
(45) Date of Patent: Apr. 14, 2015

(54) METHOD FOR PRODUCING THIN LAYERS

(75) Inventors: Gabriela Popa, Strasbourg (FR); Gero Decher, Khel-Marlen (DE); Fouzia Boulmedais, Strasbourg (FR); Olivier Felix, Holtzheim (FR); Pierre Schaaf, Molsheim (FR); Jean-Claude Voegel, Valff (FR); Joseph Hemmerle, Weyersheim (FR); Peng Zhao, Shanghai (CN)

(73) Assignees: Centre National de la Recherche Scientifique (CNRS), Paris (FR); Universite de Strasbourg, Strasbourg (FR)

( * ) Notice: Subject to any disclaimer, the term of this patent is extended or adjusted under 35 U.S.C. 154(b) by 0 days.

(21) Appl. No.: 13/699,050

(22) PCT Filed: May 20, 2011

(86) PCT No.: PCT/EP2011/058304
§ 371 (c)(1),
(2), (4) Date: Feb. 7, 2013

(87) PCT Pub. No.: WO2011/144754
PCT Pub. Date: Nov. 24, 2011

(65) Prior Publication Data

US 2013/0129907 A1 May 23, 2013

(30) Foreign Application Priority Data

May 21, 2010 (FR) ..... 10 53976

(51) Int. Cl.
*B05D 1/34* (2006.01)
*B05D 1/36* (2006.01)
*B05D 1/02* (2006.01)
*C23C 18/12* (2006.01)

(52) U.S. Cl.
CPC .. *B05D 1/02* (2013.01); *B05D 1/34* (2013.01); *B05D 1/36* (2013.01); *C23C 18/1204* (2013.01)

(58) Field of Classification Search
USPC ..... 427/426, 427
See application file for complete search history.

(56) References Cited

U.S. PATENT DOCUMENTS

| | | | |
|---|---|---|---|
| 2,996,406 | A | 8/1961 | Weinrich |
| 3,084,063 | A | 4/1963 | Barnes et al. |
| 4,675,207 | A | 6/1987 | Nicolau |

(Continued)

FOREIGN PATENT DOCUMENTS

| | | | |
|---|---|---|---|
| WO | 8500993 | A1 | 3/1985 |
| WO | 9100606 | A1 | 1/1991 |

(Continued)

OTHER PUBLICATIONS

International Search Report for PCT/EP2011/058304 dated Nov. 11, 2011.

(Continued)

*Primary Examiner* — Cachet Sellman
(74) *Attorney, Agent, or Firm* — Banner & Witcoff, Ltd.

(57) ABSTRACT

The invention relates to a method for providing organic, semi-organic, mineral, inorganic and hybrid thin layers and thin layers containing nanoparticles, by simultaneous or alternate spraying of solutions of reactive partners (that is polymer/polymer interacting by hydrogen bonding, polyelectrolyte/small oligo-ion, inorganic compounds, etc.) on the surface of a solid substrate.

20 Claims, 16 Drawing Sheets

(56) References Cited

U.S. PATENT DOCUMENTS

Figure 1:
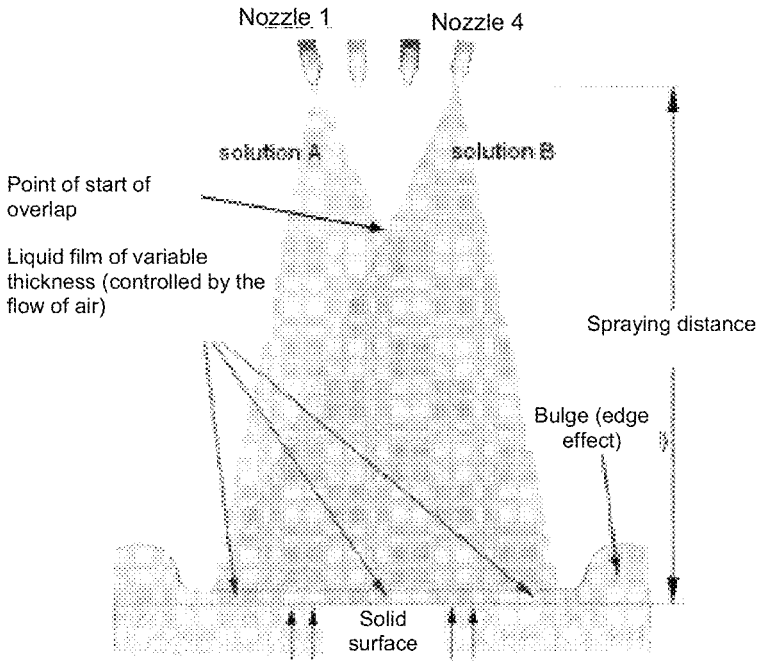

| | | | | |
|---|---|---|---|---|
| 4,837,046 | A * | 6/1989 | Oishi et al. | 427/535 |
| 5,215,789 | A | 6/1993 | Kugan | |
| 6,451,871 | B1 | 9/2002 | Winterton et al. | |
| 2004/0098839 | A1 * | 5/2004 | Brenek et al. | 23/295 R |
| 2008/0213334 | A1 * | 9/2008 | Lockwood et al. | 424/423 |
| 2010/0247599 | A1 * | 9/2010 | Krohne et al. | 424/423 |

FOREIGN PATENT DOCUMENTS

| | | | |
|---|---|---|---|
| WO | 9935520 | A1 | 7/1999 |
| WO | 0039358 | A1 | 7/2000 |

OTHER PUBLICATIONS

Nicoleau Y. F. Appl. Surf. Sci. 1985, 22-23, 1061-1074.

Nicoleau Y. F. et al. J. Cryst. Growth. 1988,92, 128-142.

Pathan H. M.; et al. Bull. Mater. Sci., vol. 27, No. 2, Apr. 2004, pp. 85-111.

Felix O. et al., C. R. Chim., 2009, 12, 225-234.

Schlenoff J. B., Dubas S. T., Farhat T. Sprayed polyelectrolyte multilayers. Langmuir 2000, 16, 9968-9969.

Izquierdo A. et al., Langmuir 2005, 21, 7558-7567.

Patil P. S., "Versatility of chemical pyrolysis deposition", Materials Chemistry and Physics, vol. 59, Issue 3, Jun. 15, 1999, pp. 185-198.

Sawada Y. et al., "Highly-conducting indium—tin—oxide transparent films fabricated by spray CVD using ethanol solution of indium (III) chloride and tin (II) chloride", Thin Solid Films, vol. 409, Issue 1, Apr. 22, 2002, pp. 46-50.

* cited by examiner

METHOD FOR PRODUCING THIN LAYERS

The present invention relates to a novel method for producing organic, inorganic, mineral, hybrid thin layers or those containing nanoparticles by alternate or simultaneous spraying of different solutions.

Generally speaking, spraying is used for different industrial applications: automobile industry, food processing industry, chemical industry, paper industry, electronics industry, etc.

It is a method that can resolve problems such as lubrication, cooling of steel, cleaning of different recipients (reactors, pipes, etc.), manufacture and cleaning of different packaging (glass, preserves, etc.). Spraying is a complex technique that is found in industry and in nature (rain, waterfalls and in oceans). It is the subject of numerous scientific publications and patents. This important field of engineering has incited theoreticians to develop models to describe the phenomenon of spraying and engineers to conduct different studies (change of key parameters for spraying: shape/diameter of the nozzle, liquid-gas mixing, adaptation of the spraying for a precise application, characterisation of jets according to several methods, finding other fields of application for spraying).

Thus, different types of spraying exist: spray-aerosols that make it possible to vaporise a liquid by the pressurised gas that is in the aerosol, sprayings delivered by a carrier gas (it is necessary to distinguish the surrounding gas playing a passive role for example for single compound nozzles and the carrier gas playing an active role for nozzles with 2 compounds or more) with different pressures (low, medium, high). Moreover, the liquid-gas mixing can take place in different ways as a function of the geometry of the nozzle, by generation of a spray by a turning device, by electrostatic spraying, by ultrasonic spraying, etc. The implementation techniques of all these nozzles are well known to those skilled in the art. For example, the presence of gas is not mandatory in certain specific cases. Nevertheless, in a more usual manner the invention takes place at atmospheric pressure, or even reduced pressure.

In particular, the spraying method has already been used to produce multilayers of polyelectrolytes. It is much faster than the soaking method in the case of nanometric thin layers of polyelectrolytes. The construction of multilayers by alternate spraying is already known (see WO 99/35520 and U.S. Pat. No. 6,451,871, Schlenoff J. B., Dubas S. T., Farhat T. Sprayed polyelectrolyte multilayers. Langmuir 2000, 16, 9968-9969).

In addition, the comparison between soaking and spraying has already been made (Izquierdo A. et al., Langmuir 2005, 21, 25 7558-7567), as well as the verification of the internal structure of the multilayers of polyelectrolytes prepared by soaking and spraying (Félix O. et al., C. R. Chim., 2009, 12, 225-234).

Nevertheless, and in particular, the present invention proposes using simultaneous or alternate spraying to produce organic, inorganic, mineral, hybrid thin layers or those containing nanoparticles.

At present, the methods used to obtain thin layers of materials are essentially CVD (chemical vapour deposition), PVD (physical vapour deposition), molecular jet epitaxy, plasma deposition, pulsed laser deposition, deposition by the sol-gel method, electrochemical deposition or electrostatic deposition.

Each method has its advantages and drawbacks.

In general, the thin layers are obtained using external factors: either by heating the substrate ("Versatility of chemical pyrolysis deposition", Patil P. S., Materials Chemistry and Physics, Volume 59, Issue 3, 15 Jun. 1999, Pages 185-198, or by evaporating the solutions (CVD), or by using lasers ("pulsed laser deposition"), etc.

A particularly interesting technique for the production of a large variety of inorganic thin layers is the SILAR method (Successive Ionic Layer Adsorption and Reaction) which is well described (Nicolau, Y. F. Appl. Surf. Sci. 1985, 22-3, 1061-1074; U.S. Pat. No. 4,675,207; Nicolau, Y. F. et al. J. Cryst. Growth. 1988, 92, 128-142; Pathan, H. M.; et al. Bull. Mater. Sci., 2004, 27(2), 85-111).

Its principle, similar to that of the layer by layer technique, is based on the consecutive immersion of surfaces in different liquids. These two methods make it possible to construct nanometric thin layers with precise thicknesses but suffer from the same drawback, namely that the immersion of an object in a liquid is a time consuming process, thus limiting its use to small and simple objects from which the liquid flows easily.

The CVD spraying method, for example, has already been used for the deposition of thin conductive layers intended for microelectronics ("Highly-conducting indium-tin-oxide transparent films fabricated by spray CVD using ethanol solution of indium (III) chloride and tin (II) chloride", Sawada Y. et al., Thin Solid Films, Volume 409, Issue 1, 22 Apr. 2002, Pages 46-50. A solution of indium chloride with different percentages of tin chloride was sprayed with an atomiser onto a substrate heated to 350° C. used in the cosmetics industry.

The patent U.S. Pat. No. 5,215,789 also describes a method for depositing inorganic materials on a substrate. Said method consists in producing positively charged ions and making them migrate into a negatively charged zone. A substrate is placed between the two zones, and a uniform deposition of a thin layer of a coating material ensues at the surface of the substrate, which interposes itself in the passage of the ionised flux. The deposition takes place in a vacuum chamber.

Another example of spraying to obtain layers of inorganic materials is given in the patent application PCT WO 91/00606. This application describes the deposition of metals. The method that is disclosed involves the projection in a controlled manner of a flux of vaporised molten metal particles. The deposition is controlled by the use of a gas nozzle that turns around said flux. The gas nozzle is directed along the axis of the flux of particles and inclined in the direction of the flux so as to produce the desired coating of a substrate.

Other technique: in the patent WO 00/39358, a method is described making it possible to deposit a thin coating, and at low cost, by the use of a colloidal spray. Thus, a colloidal suspension is forced through an ultrasonic nebuliser, which sprays a fine "mist of particles" onto a heated substrate. The coating may be dense or porous, of a thickness from 1 to several hundreds of microns. Thus, the invention described in WO 00/39358 enables the preparation of systems requiring durable and chemically resistant coatings or coatings having other specific chemical or physical properties. Moreover, this method is particularly useful for depositing ceramic coatings. Dense ceramic coatings on porous substrates make it possible for example to provide electrodes with improved performances in devices such as fuel cells.

In order to solubilise the product to be deposited on the substrate, a supercritical fluid may be used. This is described in the patent application PCT WO 85/00993. It is disclosed in said application that the solution obtained is high in pressure and sprayed via an orifice into a region of relatively low pressure. The spray thus formed enables the coating of a substrate and the low pressure makes it possible, by evaporation of the solvent, to avoid any agglomeration linked to said solvent. Said device can also serve to recover a fine powder.

In light of the teachings of the documents of the prior art, it is clear that all these methods have notable drawbacks, for example a more or less pronounced passage under vacuum of the product to be deposited, adhesion issue, complexity or high costs. Moreover, the methods of manufacturing thin layers are mainly applied to small surfaces. For treating surfaces of 50 cm×60 cm, it is necessary to use technology such as plasma cathodic sputtering: HiTUS (High Target Utilisation Sputtering), which remains costly.

The subject matter of the present application makes it possible to obtain thin layers by alternate or simultaneous spraying of solutions of reactive partners while minimising, or even eliminating, some of the drawbacks described previously.

The method known as "layer by layer" (also known by the technical name "LbL"), which is mainly applied with polyanions and polycations, has thus been extended in the present invention by means of sprayings of solutions, preferentially aqueous. Nevertheless, instead of placing in contact the two reactive partners alternately with each other at an interface to form an LbL film, the method according to the present invention is based on the simultaneous spraying of several solutions containing said reaction partners on the surface of a substrate. This results in a continuous and gradual accumulation of coatings, the thicknesses of which are directly controlled by the spraying time (the thickness can also vary as a function of different parameters such as the spraying time, concentration, type of atomiser, carrier gas or not, etc.), whereas the excess of solvent(s) or secondary products/reaction partner(s) not having reacted is mainly eliminated by drainage but also by evaporation. The thin layers obtained by the method according to the present invention may be amorphous, crystalline or polycrystalline with variable density and porosity. Typically, in the case of organic compounds, of polymer type for example, the thin layer obtained is rather amorphous. Typically, in the case of inorganic layers, the thin layer obtained is rather polycrystalline. The method according to the present invention applies not only to polyanions and polycations, but also to many other types of reactive partners: polyelectrolytes and oligo-ions charged in an opposite manner, polymers interacting via hydrogen bonding, polyelectrolytes with nanoparticles, and even complementary inorganic compounds. The general condition to respect for the formation of thin layers according to the present invention is the rapid interaction between the reactive partners, enabling them to deposit/crystallise/precipitate rapidly on the surface of the substrate. The rapid formation of certain inorganic or polymeric based complexes for example is thus particularly adapted to the method of the present invention. This is explained by rapid physical-chemical interactions, such as for example the formation of electrostatic bonds. Thus, the diversity of the nature of the thin layers that can be formed by the method according to the present invention is a major advantage.

In addition, the method according to the present invention is extremely practical to use and makes it possible to deposit thin layers on large surfaces of substrate(s). Moreover, the extreme homogeneity of the thin layers produced by the method of the present invention has been demonstrated by observation of optical interferences in visible light. This property enables their application in the manufacture of various devices, for example optical, or quite simply in scientific studies. Thus, the uniform colour of the thin layers exposed to white light indicates a constant refractive index and thus a homogeneous thickness, said thickness of the thin layer conventionally reaches from several hundreds of nanometers to several tens of micrometers, according to the spraying time (from several seconds to several tens of minutes).

The method of the present invention has the advantage of forming thin layers very rapidly. In several minutes it is possible to attain micrometric thicknesses. Advantageously, the technique described in the present application is based on the use of aqueous solutions, an "ecological" method without other solvent than water.

In addition, the spraying method according to the present invention is easy to use for covering large surfaces with homogeneous layers.

Moreover, it is possible according to the present invention to accumulate the use of several nozzles in order to make several reagents react together during the spraying on the substrate. Producing thin layers, in particular inorganic, is thus a novelty of the method described in the present application.

The great originality of the method according to the present invention stems from the use of at least two aqueous inorganic solutions soluble at ambient temperature that are going to react after spraying to give a layer of inorganic crystals. The solutions are sprayed onto a surface and their mixing leads to the formation of inorganic thin layers. The spraying may be carried out according to two methods: the alternate spraying of the solutions or the simultaneous spraying of the solutions. These two approaches open large perspectives for numerous applications.

In addition, by working only with aqueous solutions the risk of fires, explosions or other accidents is very low. The present invention is a reproducible method, easy to put in practice with aqueous solutions and an atomiser which leads to a thin layer, the thickness of which can vary as a function of different parameters (spraying time, concentration, type of atomiser, carrier gas or not). Moreover, the passage from the laboratory scale to the industrial scale can be accomplished easily.

The applications are extremely vast and cover all of the conventional uses of thin layers, such as reflective or anti-reflective coatings (for example for photovoltaic cells), insulators, anticorrosion coatings, semi-conductors for micro-electronics, biological micro-sensors, bio-chips, biocompatible materials, mechanical and chemical sensors, microfluidics, etc. All of the applications cited do not necessarily require a thin layer structure stratified at the nanometric scale. In such cases, the simultaneous spraying according to the present invention has the advantage of being a rapid technique, while being applicable to large surfaces. In fact, multi-nozzle technology (2 and more) enables the consecutive application of 2 different pairs of complementary reactive partners by simultaneous spraying making it possible to produce easily thin stratified layers and thus incorporating different materials and thus different functionalities. Furthermore, the combination of several deposition methods, for example LbL and simultaneous spraying, also makes it possible to obtain stratified multi-material layers.

From a practical viewpoint, the formation of the thin layers of the present invention has highlighted numerous advantages. Thus, the method described stands out from the previously enumerated methods through:

- its great simplicity (direct spraying of aqueous solutions of different reactive partners),
- its lower production cost (use of a normal paint airbrush or atomiser, and thus low energy consumption),
- the possibility of forming homogeneous layers on a large surface, the possibility of covering surfaces without restriction either of the geometry, or of the nature of the surface (large variety of substrates for the deposition: silicon, plastic, glass, quartz, etc.), low polluting technology (since it uses aqueous solutions).

SUMMARY OF THE INVENTION

The invention consists in a method for the deposition, on a substrate, of a thin layer of a product obtained from at least two reactive partners. The method according to the invention involves the simultaneous or alternate spraying, on said substrate, using separate sprayers, of at least two liquids each containing one of the reactive partners (organic, inorganic, mineral or nanoparticles) or a mixture thereof, such that they interact with each other mainly at the level of a liquid film of controlled thickness comprised between 0.1 μm and 100 μm that forms on contact with the free surface of the substrate, to the exclusion nevertheless of the case where two reactive partners of polymer nature, each of identical chemical nature, interact by electrostatic interactions (1 polyanion and 1 polycation) and are deposited by simultaneous spraying, and to the exclusion also of the case where all the reactive partners are deposited by alternate spraying, except for the case where at least the 2 partners are of inorganic nature.

DEFINITIONS

The term "spraying" according to the present invention relates to the production of a cloud of droplets, in other words containing droplets of micro or nanometric size in suspension in the gas that contains them and which potentially conveys them, or the space that contains them (in the case of an ultrasonic nozzle). A "nozzle" is a device that enables such spraying.

The droplets can touch each other within the actual cloud that they form. These collisions can bring about inter-droplet coalescences. Thus several (two or more) droplets can combine and mix to only form a single droplet.

The term "film" according to the present invention is well known to those skilled in the art. This term refers to a liquid layer formed on a substrate by spraying according to the present invention. The thickness of the liquid layer may be comprised between ten or so nanometers and several hundreds of microns. Moreover, in the present invention, the film comprises one (or more) solvent(s), preferentially water, and "solutes", in other words the reactive partners. Moreover, the reaction between the reactive partners within the liquid film leads to the formation of a product at a super-saturated concentration that is going to catch onto and deposit on the surface of the solid support in the form of a thin layer. Advantageously, the method according to the invention makes it possible to obtain a film having a thickness of 0.1 to 50 μm.

"Solvent" according to the present invention is taken to mean any product or substance enabling the dissolution of another product. Moreover, it is possible that molecules of solvent participate in the structure of the thin layer. It is possible to vary the viscosity of the solvent in order to modulate the characteristics of the spraying (size of the droplets, speed of drainage, rapidity of the reaction, etc.). For example, the addition of neutral polymer(s) (in other words not reacting with the reactive partners) in the solvent may increase the viscosity of the solvent.

"Reactive partners" according to the present invention is understood to mean any type of chemical entity, atom or molecule, that can bond to another chemical entity, atom or molecule, identical or different, potentially dissolved in one or more solvents.

"Reactive partners of polymer nature" is particularly taken to mean any macromolecule, organic or not, constituted of repeating sequences of units or monomers, identical or not, all connected together by covalent bonds.

"Controlled thickness" according to the present invention is taken to mean that the thickness of the film is controlled by the parameters of spraying on the substrate.

A "thin layer" according to the present invention needs to be differentiated from a liquid film of the present invention. In fact, a thin layer is preferentially free of solvent, except if the latter is involved in the actual structure of said thin layer. The thin layer is a compact layer, polycrystalline and/or amorphous, which is advantageously free of defects and of homogeneous thickness.

It is necessary to take into account:

thin layers established by growth of islets (FIG. 23 *a-d*) with a reduction of the interstitial space between the islets during the growth of the layer, inorganic thin layers with variable porosity and degree of crystallinity, organic, hybrid (organic/inorganic), mineral thin layers or those containing nanoparticles.

"Free surface" according to the present invention is taken to mean that it is the bare surface of the substrate, in other words the surface of said substrate which can be covered by a liquid film then a thin layer according to the invention by evaporation/crystallisation/precipitation of at least one of the solvents/products contained in the film.

The term "substrate" according to the present invention designates a solid support on which at least one thin layer according to the invention is going to be deposited. Said support may be of any nature, in other words natural or synthetic, organic, mineral or inorganic, crystalline, polycrystalline and/or amorphous.

Advantageously, the substrate may be in movement with respect to the spraying jets and micro-agitated by ultrasounds.

The expression "polymer nature" according to the present invention is well known to those skilled in the art as being applicable to substances, generally organic or semi-organic, characterised by the repetition of one or more types of monomer units.

DETAILED DESCRIPTION

Reactive Partners

The preferred embodiments of the present invention relating to the reactive partners are obviously applicable to other embodiments relating to the other technical criteria of the present invention.

The production of the materials takes place through transformation of matter, either by chemical reaction, by physical-chemical or physical interaction, by biological interaction, etc. Thin layers do not depart from this rule. Thus the choice of reactive partners is made on the one hand with a view to the chemical composition of the final thin layer desired, and on the other hand by the choice of its method of production, in other words by chemical reaction, physical-chemical interaction, etc.

The embodiment of the method according to the invention is firstly determined by the choice of the reactive partner(s).

A particular embodiment according to the present invention relates to reactive partners leading to a product to be deposited by physical or physical-chemical interaction.

Thus, any physical or physical-chemical technique applicable in the case in point and known to those skilled in the art may be used for the formation of the thin layer. An additional manipulation could consist in the use of laser technology, or instead in the use of a strong magnetic and/or electric field, the piezoelectric effect, ultrasounds, the application of an electrospray, electrochemistry, microwaves, or even a simple heat treatment, for example.

It is also possible to use a gas such as nitrogen or instead an inert gas such as argon in the embodiment of the method, whether it is as carrier gas in the spraying, or quite simply in the enclosure where the spraying is carried out, or both. It is also possible to deposit films according to the present invention by the use for example of ultrasonic nozzles. The present invention may be carried out under ambient atmosphere. It is obviously also possible to use an oxidising, reducing or reactive gaseous atmosphere in the implementation of the method of the present invention.

Obviously, those skilled in the art will make their choice of reaction partner as a function of the physical-chemical and/or physical technique applied.

Another advantageous method according to the present invention relates to the reactive partners, which reactive partners lead to the product(s) to be deposited by chemical reaction.

Another advantageous method according to the present invention relates to reactive partners comprising a mineral, inorganic, organic product or of nanoparticle type and two solvents, the first of which is a solvent of said product and the second a non-solvent of said product.

In an advantageous manner, one at least of the reaction partners of the method according to the invention is of inorganic nature.

In a particular embodiment, the reactive partners of the method according to the invention are aqueous solutions of complementary inorganic cations and anions.

The term "complementary" is taken to mean that the cation(s) and the anion(s) react together to form one or more of the desired products.

For example, a particular embodiment of the method of the present invention is the crystallisation of a salt, thus composed of an anion and a cation. It is possible to form said salt from two different couples of dissolved salts, by spraying two separate solutions each containing one of the two couples of salts. The reaction thus produces a compound that crystallises according to the equation $$(An_1/Cat_1)+(An_2/Cat_2)\rightarrow(An_1/Cat_2)_{Thin\ layer}+(An_2/Cat)_1,$$

"An" being Anion and "Cat" being cation.

The couples $(An_1/Cat_1)$, $(An_2/Cat_2)$ and $(An_2/Cat_1)$ are in solution, whereas $(An_1/Cat_2)$ precipitates or crystallises, thus forming the thin layer on the surface of the support. The couples in solution are eliminated from the surface of the substrate at the same time as the solvent(s), thus in most cases by drainage.

In a particular embodiment, one of the reactive partners of the method according to the invention is a small organic molecule, a polymer or a nanoparticle, with the exception nevertheless of the case where two reactive partners of polymer nature, each of identical chemical nature, interact by electrostatic interactions (1 polyanion and 1 polycation) and are deposited by simultaneous spraying, and to the exclusion also of the case where all of the reactive partners are deposited by alternate spraying, except for the case where the 2 partners are of inorganic nature.

"Small organic molecule" is taken to mean molecules, the molecular weights of which are less than 2000 $g\cdot mol^{-1}$ and having several interaction sites (hydrogen bonding, electrostatic interactions, etc.).

The origin of the polymer may be natural or synthetic. The polymer may be organic or even semi-organic, of an undefined or defined size, of small size, in other words of a molecular weight comprised up to 2000 $g\cdot mol^{-1}$, or of a larger size, in other words of a molecular weight greater than 2000 $g\cdot mol^{-1}$. For example, the polymer may be a sequencing of amino acids that form a peptide, a sequencing of sugars that form a polysaccharide, a fragment of DNA or RNA, a polyacrylate, a polystyrene, cellulose or a derivative (methyl hydroxypropylcellulose, for example), etc.

Semi-organic compound is taken to mean that the compound contains an organic fragment (thus hydrocarbonated), and another inorganic part. This is the case of organic iron complexes and inorganic or metal nanoparticles, for example.

Control of the Interaction Between the Reaction Partners

The preferred embodiments of the present invention relating to the control of interactions between the reactive partners are obviously applicable to other embodiments relating to the other technical criteria of the present invention.

Thus, according to the method of the present invention, the interaction between the reactive partners is advantageously controlled by determination of one at least of the following adjustment parameters:

- concentration of the reactive partners in each liquid and viscosity of each of the spraying liquids containing the reactive partners;
- composition and nature of the solvent present in each of the liquids sprayed;
- temperature of the liquids sprayed;
- dimension, density, speed and polydispersity of the droplets as a function of the geometry and the nature of the spraying nozzles;
- variation of the angles at the tip of the dispersion cones of the spraying jets;
- distance between the nozzles and the surface of the substrate to be coated;
- slope of said surface with respect to the main axis of the spraying jets;
- flow rate of spraying jets of the different liquids;
- flow rate of the carrier gas used for the sprayings;
- nature, temperature, flow rate and/or pressure of the carrier gas used for the sprayings;
- nature of the solid support.

In a particular embodiment of the present invention, the following spraying nozzles are used:

- model A480 of the firm Aztek, USA, and/or
- model 280004 of the firm Sedip, France, and/or
- model VL of the firm Paasche, USA.
- nozzle of the firm Spraying Systems Co, USA.

For these spraying nozzles, advantageously the following spraying parameters are applied:

- gas pressure comprised between 0.1 and 10 bars, preferentially comprised between 0.5 and 5 bars, more preferentially comprised between 1 and 3 bars,
- flow rate of the solutions sprayed comprised between 0.1 and 30 mL/min, preferentially between 1 and 25 mL/min, more preferentially comprised between 2 and 21 mL/min, even more preferentially comprised between 3 and 19 mL/min.

Obviously, the spraying parameters depend among other things on the nozzles used. Thus the models of nozzles cited above, which were used in laboratory scale reactors, need to be adapted to each situation. In particular, spraying nozzle sizes at the industrial scale being in all likelihood different to those used at the laboratory scale, those skilled in the art will know how to adapt the spraying parameters depending on each case.

Spraying

The preferred embodiments of the present invention relating to the spraying criteria are obviously applicable to the other embodiments relating to the other technical criteria of the present invention.

The spraying of the different liquids against said substrate in the method according to the invention may be carried out in an alternate or simultaneous manner.

The spraying of the different liquids on said substrate in the method according to the invention is carried out in an alternate manner, uniquely when the reactive partners are of complementary inorganic natures.

Advantageously in the method according to the invention, the surface of the substrate and the spraying nozzles are moveable in relation to each other, so as to ensure the deposition of the thin layer on all of the substrate and to improve the homogeneity of the thin layer.

Moreover, in a particular embodiment of the method according to the present invention, the operation of alternate or simultaneous spraying is followed by a heat treatment.

The spraying according to the present invention may be carried out continuously or it may be interrupted, without affecting the integrity of the thin layer obtained at the end of the method. In fact, it has been noted that an interruption of the deposition does not influence the growth of the thin layers. The same thicknesses of thin layers are obtained, whether said thin layers are produced in a single step or in several steps, the important thing being that the total spraying time is constant, even if the thin layer is dried after each step. This is true as much for polymeric, organic based coatings as inorganic. This is proof of the robustness of the method according to the invention.

Control of the Spraying

In the case of simultaneous spraying according to the method of the invention, this is conducted so as to control the collisions, contacts and/or coalescences of said reactive partners in the spraying jets before arriving in contact with the substrate.

In fact, the droplets can encounter each other when they are still in suspension in the gas that carries them and/or the space that contains them and coalesce at that time, or coalesce when they encounter the support or the liquid film already formed on the support. In a surprising manner, the mixing that takes place during this coalescence makes it possible to obtain a liquid film of an extreme homogeneity in the distribution of the reaction partners, enabling an optimisation of the reactions that take place in said film.

The interest of the present invention is based on the use of droplets of small size and of a liquid thin film to enable a rapid mixing of the reactive partners in the liquid film by rapid diffusion (the rate of diffusion and mixing are an inverse function of the size of the droplets and the thickness of the liquid film) leading to the growth of the thin layer.

The fusion of individual droplets with the liquid film leads to a rapid mixing of the solutions containing the reactive partners within the liquid film. Thus, a continuous renewal of the liquid film is obtained by the present invention.

Moreover, it is possible to control the surface coverage during the spraying according to the method of the invention by interposing a screen provided with an opening to select the central part of the spraying jets and avoid the contamination of the surface by the edges of the jets.

The nature of the screen may be made of any type of material and any possible shape.

It may be advantageous during the spraying according to the method of the invention to add an additional screen between the nozzle(s) and the overlap point of the spraying jets provided with at least one opening passing alternatively in front of the spraying jets to control the collisions and interactions of the sprayed droplets (FIG. 1).

In an advantageous manner, the opening of the additional screen, between the nozzle (s) and the overlap point of the spraying jets, is calibrated.

The screen may come between the nozzle(s) and the overlap point of the spraying jets by any movement whatsoever.

In an advantageous manner, the additional screen comes between the nozzle (s) and the overlap point of the spraying jets by a rotating movement. The screen is thus called rotating in this particular embodiment.

In an advantageous manner, the additional screen comes between the nozzle(s) and the overlap point of the spraying jets by a lateral linear movement on a slide system for example. The screen is thus called linear in this particular embodiment.

It may be advantageous during the spraying according to the method of the invention to interpose an additional rotating screen between the nozzle(s) and the point of start of overlap of the spraying jets.

Positioning of the Wafer

Said wafer, on which are sprayed the jets of liquid reagent, may be positioned and oriented in any manner whatsoever so as to form a thin layer. Said wafer may be positioned in a vertical manner so that the surplus of reaction liquid and/or solvent(s) flows off as spraying progresses according to the method of the present invention. Said wafer may also be inclined more or less considerably with respect to the vertical.

The variations of these slopes are dependent on the factors of spraying and/or of the formation of nanoparticles.

Advantageously, the slope of said wafer with respect to the vertical axis is low for rapid reactions of formation of thin layer or potentially not requiring additional treatment, in other words of an angle comprised between 0° and 45° with respect to the vertical axis.

Advantageously, the slope of said wafer with respect to the horizontal axis is low for slow reactions or requiring an additional treatment (for example by laser technology), in other words an angle comprised between 0° and 45° with respect to the horizontal axis.

Control of the Air Flow: Control of the Thickness of the Liquid Film

The thickness of the film formed is directly linked to the flow of air imposed. Thus, according to the method of the invention, the spraying is carried out with a flow of air intended to control the thickness of the liquid film which forms on contact with the free surface of the substrate. The homogeneity of the thickness of the film is also influenced by the flow of liquid, the nature of the substrate, the viscosity of the liquid (concentration) and the positioning of the nozzles.

Sprayers

Different sprayers may be used in the present invention, such as for example:

- a single component sprayer, for example spraying a single liquid under pressure,
- a multi-component sprayer, for example a chemical compound in solution in a solvent medium,
- a nebuliser involving the spraying of a gas and a liquid,
- a piezoelectric sprayer,
- an atomiser, or instead,
- an ultrasonic sprayer.

The quality of the spraying and thus of the liquid film obtained is also determined by the positioning of the nozzles of the sprayers (overlap of the spraying jets).

Thus, in an advantageous manner according to the method of the present invention, the nozzles are arranged so that the spraying jets arrive at the surface of the substrate along a direction essentially orthogonal with respect to the latter.

Particular Embodiment

In a particular embodiment of the present invention, the following spraying nozzles are used:

model A480 of the firm Aztek, USA, and/or model 280004 of the firm Sedip, France, and/or model VL of the firm Paasche, USA nozzle of the firm Spraying Systems Co, USA For these spraying nozzles, advantageously the following spraying parameters are applied:

gas pressure comprised between 0.1 and 10 bars, preferentially comprised between 0.5 and 5 bars, more preferentially comprised between 1 and 3 bars, flow rate of the sprayed solutions comprised between 0.1 and 30 mL/min, preferentially between 1 and 25 mL/min, more preferentially comprised between 2 and 21 mL/min, even more preferentially comprised between 3 and 19 mL/min, sprayed aqueous solutions, spraying gas used: compressed air or nitrogen.

Obviously, the spraying parameters depend among other things on the nozzles used. Thus the models of nozzles cited above that have been used in reactors at the laboratory scale need to be adapted to each situation. In particular, the sizes and the characteristics of the spraying nozzles at the industrial scale being in all likelihood different to those used at the laboratory scale, those skilled in the art will know how to adapt the spraying parameters depending on each case.

Films and Thin Layers

The preferred embodiments of the present invention relating to the liquid films and the thin layers obtained are obviously applicable to other embodiments relating to the other technical criteria of the present invention.

Liquid Film

The thickness of the film obtained on contact with the free surface of the substrate according to the method of the present invention may be comprised between ten or so nanometers and several hundreds of microns.

Advantageously, the liquid film obtained on contact with the free surface of the substrate according to the method of the present invention is of a controlled thickness comprised typically between 0.1 μm and 100 μm, more advantageously between 0.1 and 50 μm, even more advantageously between 0.5 and 5 μm.

The film obtained on contact with the free surface of the substrate according to the method of the present invention has a substantially constant thickness.

Thin Layer

The thickness of the thin layer obtained by elimination (evaporation or drainage) of the solvent(s) contained in the film and/or the crystallisation/precipitation of the products obtained in the film, on contact with the free surface of the substrate according to the method of the present invention, may be comprised between several nanometers and several hundreds of microns.

A particularly important technical criterion in the understanding of the method according to the invention thus relates to the solubility of the thin layer.

In fact, in the method according to the invention, it is advantageous that the solubility of the material of the thin layer deposited is lower than the solubility of the reactive partners in the liquid spraying solutions.

Thus, the solubility of the material constituting the thin layer is lower than that of the reactive partners. Thus, the material is going to deposit progressively on the surface of the substrate more easily than the reactive partners individually and grow the thickness of the thin layer as a function of the spraying time (simultaneous spraying) or the number of spraying cycles (alternate spraying).

Moreover and in an advantageous manner, in the method according to the present invention, a thin layer of different inorganic crystals may be deposited selected from for example, calcium phosphate, calcium fluoride, calcium oxalate, Prussian blue, silver chloride, iron phosphate, copper sulphide (CuS), zinc sulphide (ZnS), cadmium sulphide, indium sulphide, tin sulphide, lead sulphide, arsenic sulphide, antimony sulphide, molybdenum disulphide, manganese sulphide, iron sulphide ($FeS_2$), cobalt sulphide, nickel sulphide and lanthanum sulphide, copper selenide ($Cu_2Se$), silver selenide, zinc selenide, antimony selenide, indium selenide, cadmium selenide, bismuth selenide, lanthanum selenide, copper tellurate, cadmium tellurate, indium tellurate, lanthanum tellurate, copper oxide, zinc oxide, manganese oxide, cerium oxide, copper and indium sulphide, cadmium and zinc sulphide, cadmium and indium sulphide, the composites zinc sulphide/bismuth sulphide, bismuth selenide/antimony selenide.

In a particular embodiment of the method according to the present invention, the thin layer deposited moreover comprises a substance of interest, which may be used in catalysis, in optics, in optoelectronics, or instead having magnetic properties, such as mineral salts containing iron.

In a particular embodiment of the method according to the present invention, the thin layer deposited moreover comprises a substance of interest, in particular of therapeutic nature or for transfection, selected from antibiotics, anti-inflammatory agents, antibacterial agents, anticancer agents, DNA, RNA and plasmids for example.

Surface of the Substrate and Substrate

The preferred embodiments of the present invention relating to the surface of the substrate and the substrate are obviously applicable to the other embodiments relating to the other technical criteria of the present invention.

Surface of the Substrate

According to the method of the present invention which consists in depositing a thin layer on a substrate, prior to the deposition of said thin layer, advantageously, the surface of the substrate to coat is rendered adhesive. Advantageously, said surface is rendered adhesive by functionalization, for example by adsorption of PEI, by surface nucleation or instead by mineralisation of said substrate.

Substrate

As explained above, the term "substrate" designates a solid support on which is going to be deposited at least one thin layer according to the invention. This support may be of any nature, in other words natural or synthetic, organic, mineral or inorganic, crystalline, polycrystalline and/or amorphous.

In a particular embodiment, in the method according to the invention, the substrate is a bio-material. In a preferred manner, in this particular embodiment the bio-material is an implant.

Applications

There are several potential application fields for the inorganic thin layers. The inorganic layers produced by the method according to the present invention may have different applications: magnetic coatings, layers having mechanical properties, manufacture of layers for optics (for reflective or anti-reflective coatings, photovoltaic cells, for example), in micro-electronics (layers of insulators, semi-conductors and conductors of integrated circuits), storage and production of energy (photovoltaic cells), biotechnology (biological microsensors, biochips, biocompatible materials, etc.), micro and nanotechnologies (mechanical, chemical and microfluidic sensors, actuators, detectors, adaptive optics, nanophotonics, etc.), etc.

Figure Captions:

FIG. 1: Profile view of an embodiment of the spraying according to the present invention.

Figure 2:
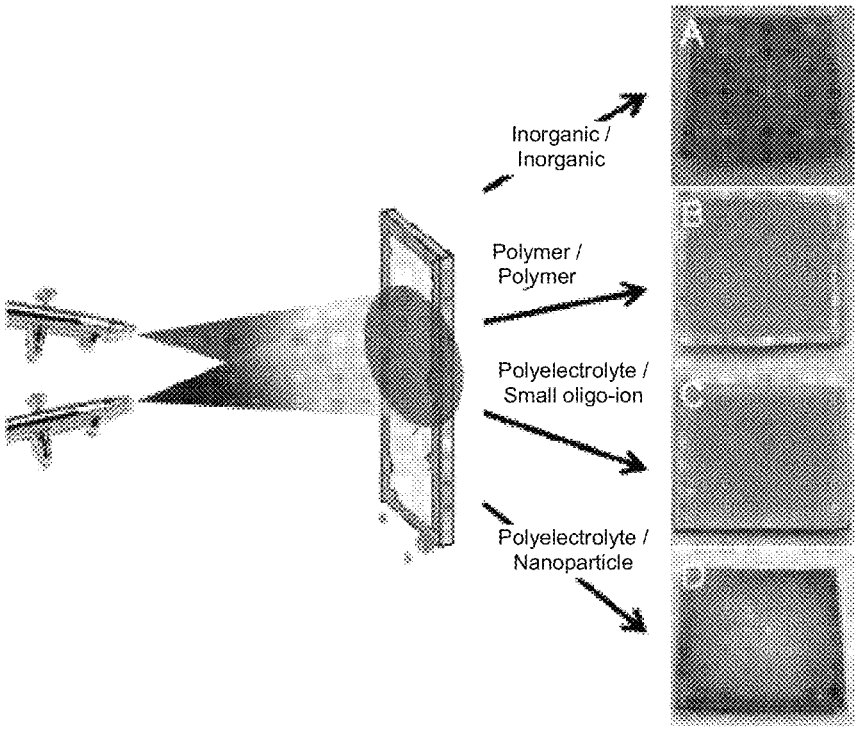

FIG. 2: Schematic representation of the system of simultaneous spraying according to the invention used for the deposition of different thin layers from 2 reactive partners of same nature or different nature (inorganic/inorganic, polymer/polymer, polyelectrolyte/small oligo-ion and polyelectrolyte/nanoparticle). On the right are presented images of thin layers deposited on silicon wafers (40 mm×40 mm) the colours of which are generated by optical interference indicating the quality and the homogeneity of the thin layers obtained. The solutions having been sprayed are: (A) NaF ($2.10^{-2}$ mol/L) and $CaCl_2$ ($2.10^{-2}$ mol/L), (B) polyethyleneoxide (0.5 mg/mL, $M_w$~50,000 g/mol, with stabilisers) and polyacrylic acid (0.5 mg/mL, $M_w$~100,000, 35% by weight in water) at pH 2, (C) PAH (1 mg/mL, Mn=56000 g/mol) and sodium citrate (0.02 mol/L), (D) PAH (1 mg/mL, Mn=15000 g/mol) and nanoparticles of gold (12 nmol/L).

The wafers of silicon were rotated slowly to improve the homogeneity of the liquid films/thin layers in each case.

Figure 3:
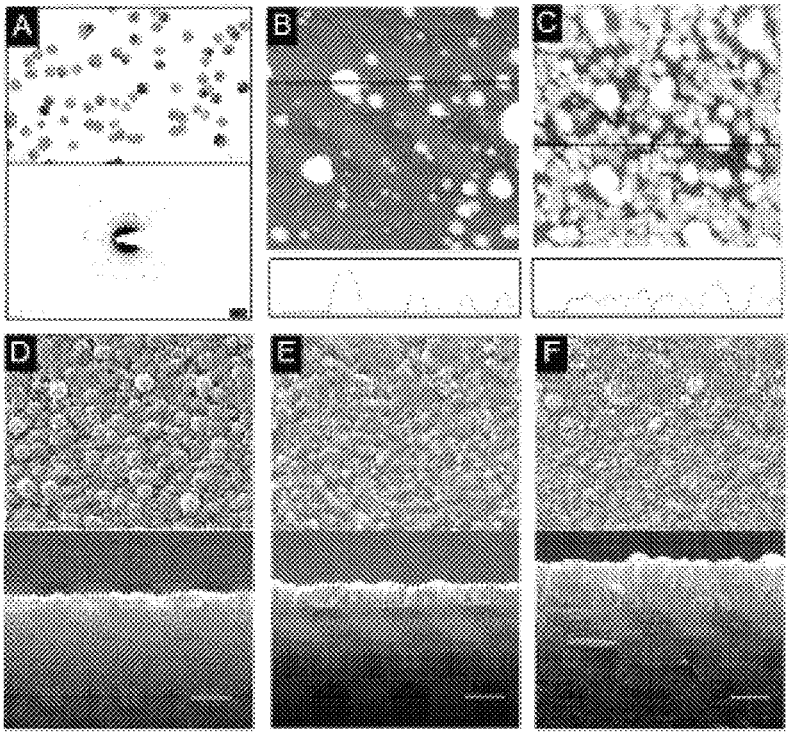

FIG. 3: Micrographs of thin layers of calcium fluoride obtained by simultaneous spraying; (A) 1 second on a "Formvar" support, analysed by TEM (upper half of the image) and electron diffraction (lower half of the image); (B) 10 S and (C) 40 S on a silicon wafer analysed by atomic force microscopy, topography (upper frame of the image) and line profile (lower frame of the image). The scanned surfaces are 5 μm×5 μm and the scale of the Z axis is 400 nm; (D) 1 min, (E) 5 min and (F) 10 min on a glass substrate, analysed by scanning electron microscopy, top view (upper half of the image) sectional view (lower half of the image). The scale bars from (D) to (F) are 2 μm.

Figure 4:
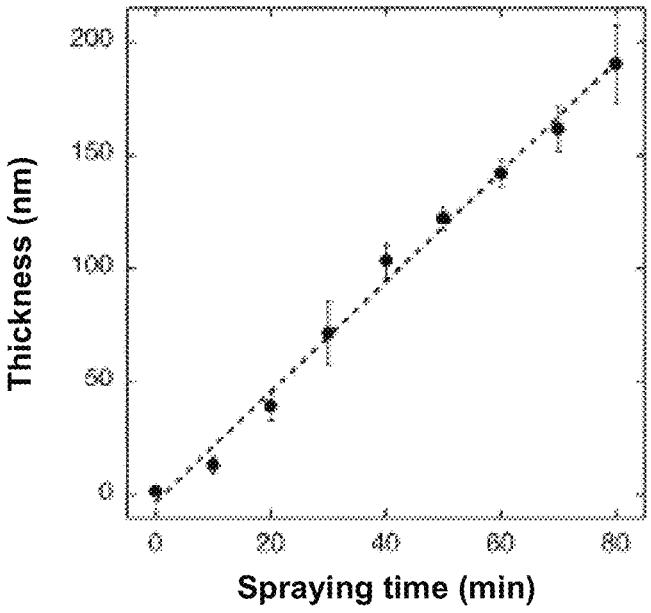

FIG. 4: Variation in the thickness of a thin layer of calcium fluoride, obtained by simultaneous spraying of solutions of calcium chloride ($10^{-2}$ mol/L) and sodium fluoride ($2.10^{-2}$ mol/L) as a function of the spraying time, measured by ellipsometry. The dotted line serves as guide for the eyes.

Figure 5:
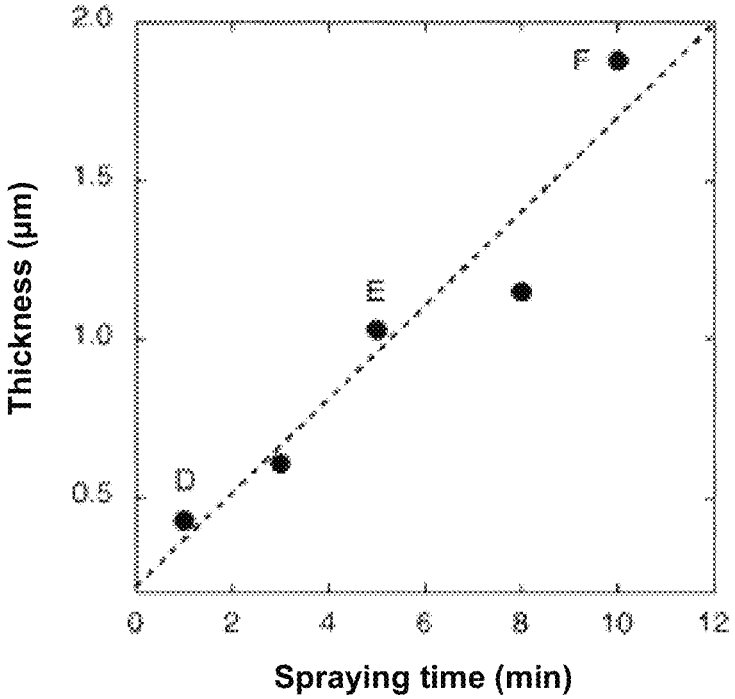

FIG. 5: Thicknesses of a thin layer of calcium fluoride, obtained for spraying times ranging from 0 to 10 minutes, measured by scanning electron microscopy. The points D, E and F correspond to the thin layers of FIGS. 2D, 2E and 2F. The dotted line serves as guide for the eyes.

Figure 6:
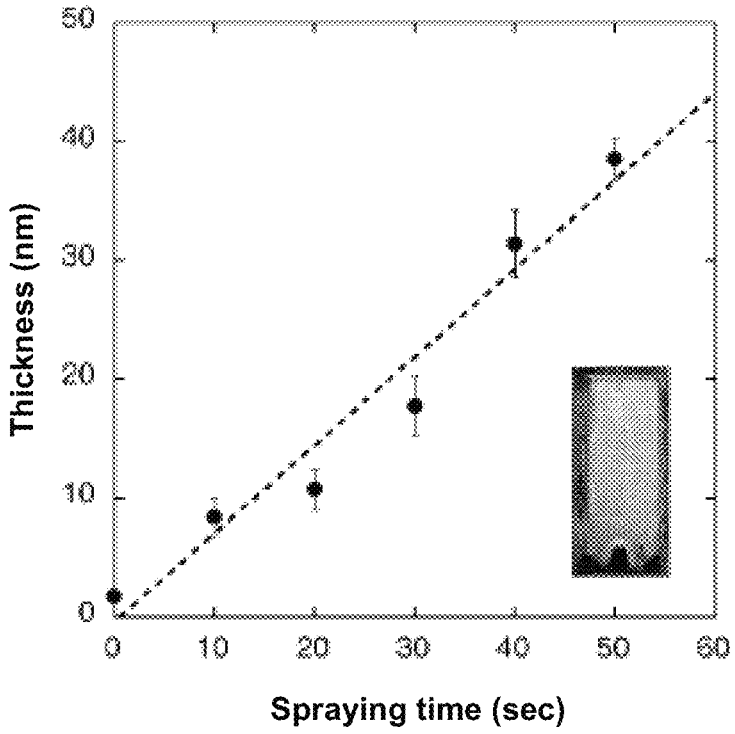

FIG. 6: Ellipsometric thicknesses of a thin layer of calcium hydrogen phosphate, obtained by simultaneously spraying solutions of calcium nitrate ($3.2.10^{-2}$ mol/L) and ammonium hydrogen phosphate ($1.9.10^{-2}$ mol/L) in a Tris buffer at pH=10 and $1.5.10^{-2}$ mol/L of NaCl, as a function of the spraying time. The dotted line serves as guide for the eyes. The polycrystalline nature of the thin layer obtained means that said thin layer appears white in reflected light. The image in the bottom right corresponds to the wafer obtained after 60 seconds of spraying. NB: In the bottom of the exposed wafer, the black mark is due to the tongs holding said wafer during the spraying.

Figure 7:
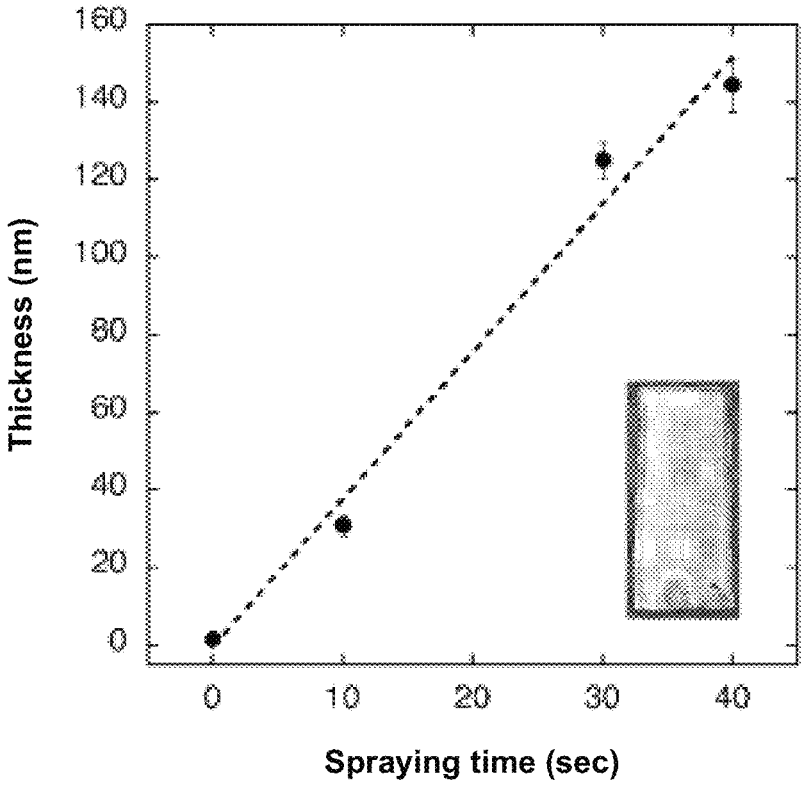

FIG. 7: Ellipsometric thicknesses of a thin layer of calcium oxalate, obtained by simultaneously spraying solutions of calcium chloride ($2.10^{-1}$ mol/L) and sodium oxalate ($10^{-2}$ mol/L), as a function of the spraying time. The dotted line serves as guide for the eyes. The image in the bottom right corresponds to the wafer obtained after 40 seconds of spraying. NB: In the bottom of the exposed wafer, the black mark is due to the tongs holding said wafer during the spraying.

Figure 8:
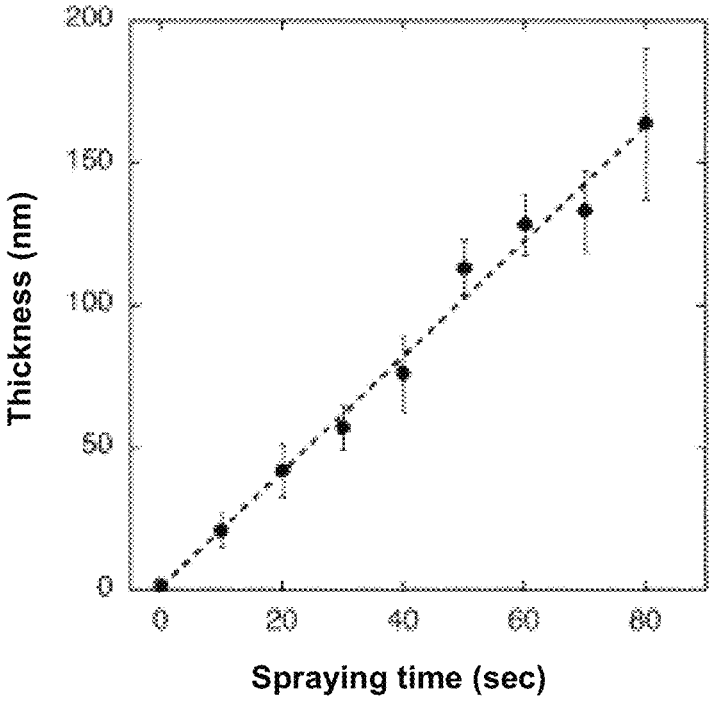

FIG. 8: Ellipsometric thicknesses of a thin layer of iron hydrogen phosphate (III), obtained by simultaneously spraying solutions of iron chloride (III) ($2.5.10^{-2}$ mol/L) and ammonium hydrogen phosphate ($3.75.10^{-2}$ mol/L), as a function of the spraying time. The dotted line serves as guide for the eyes.

Figure 9:
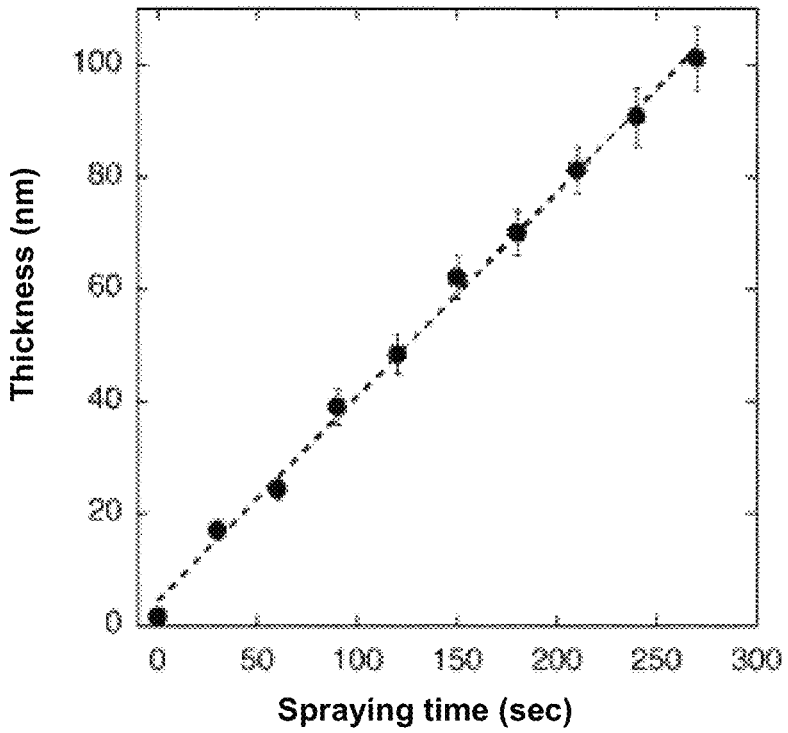

FIG. 9: Ellipsometric thicknesses of a thin layer of silver chloride, obtained by simultaneously spraying solutions of silver nitrate ($10^{-2}$ mol/L) and sodium chloride ($10^{-2}$ mol/L), as a function of the spraying time. The dotted line serves as guide for the eyes.

Figure 10:
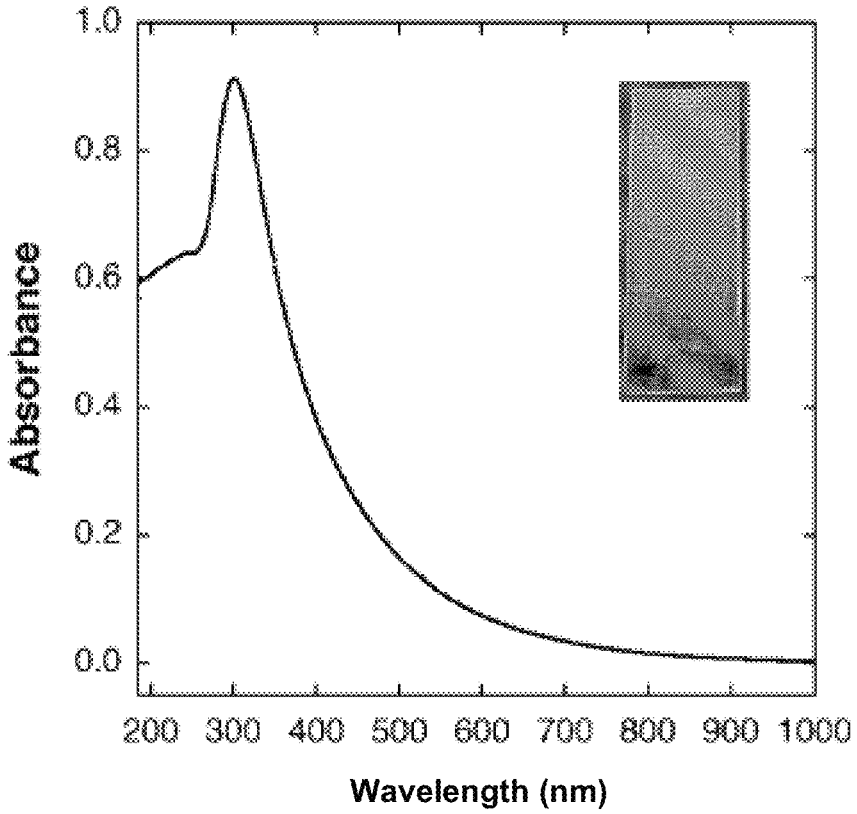

FIG. 10: UV-visible spectrum of a thin layer of silver chloride obtained by simultaneously spraying solutions of silver nitrate ($10^{-2}$ mol/L) and sodium chloride ($10^{-2}$ mol/L) after 3 minutes of spraying. The peak at around 270 nm corresponds to AgCl. The upper right image corresponds to a wafer of quartz covered with the thin layer of AgCl after 3 minutes of spraying. The polycrystalline nature of the thin layer obtained means that said thin layer appears white in reflected light. NB: At the bottom of the exposed wafer, the black mark is due to the tongs holding said wafer during the spraying.

Figure 11:
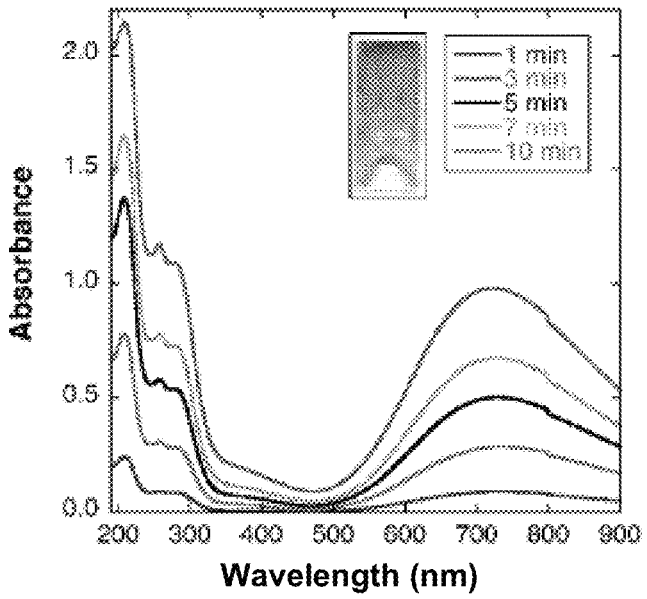

FIG. 11: UV-visible spectrum of a thin layer of Prussian blue, obtained by simultaneously spraying solutions of iron chloride (II) ($3.10^{-3}$ mol/L) and potassium hexacyanoferrate (III) ($3.10^{-3}$ mol/L), as a function of the spraying time. The spectrum shows an increase in the absorbance of the thin layer with the growth of said thin layer. The growth of the thin layer increases regularly with the spraying time. The discontinuity of the curves obtained at around 790 nm corresponds to the automatic change of filters in the spectrophotometer. The image at the top and at the centre of the figure corresponds to a wafer coated with a thin layer after 5 minutes of spraying. NB: At the bottom of the exposed wafer, the black mark is due to the tongs holding said wafer during spraying.

Figure 12:
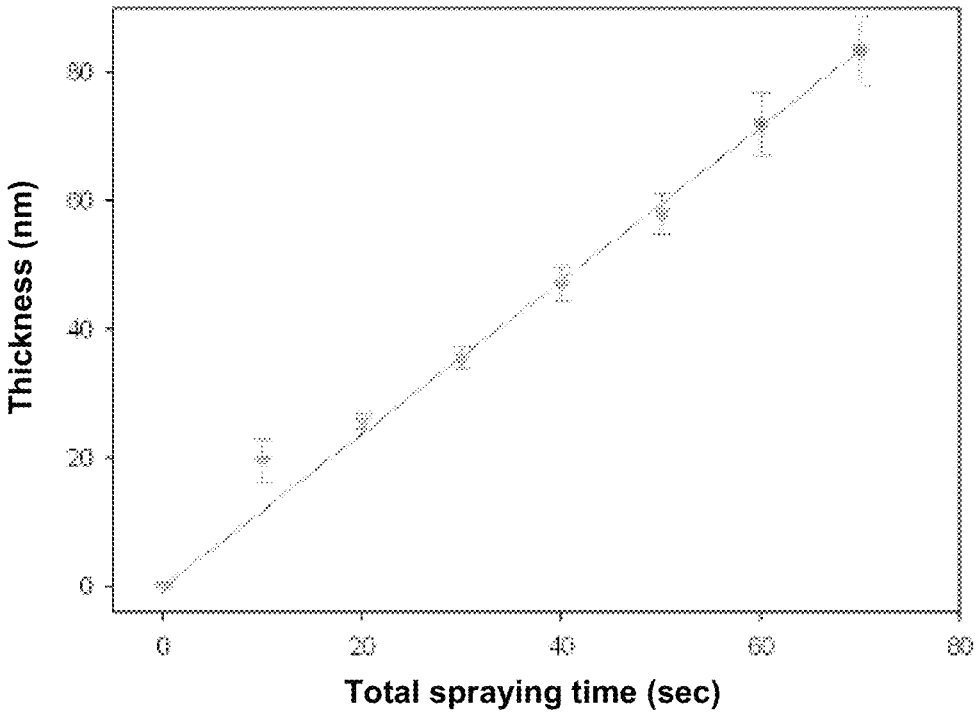

FIG. 12: Variations in thickness of a thin layer, obtained by simultaneously spraying solutions of polyethylene glycol (0.5 mg/mL) and poly(acrylic) acid (PAA) (0.5 mg/mL) at pH 2, measured by ellipsometry as a function of the total spraying time. The construction of the thin layer is based on the formation of hydrogen bonding between the two polymers.

Figure 13:
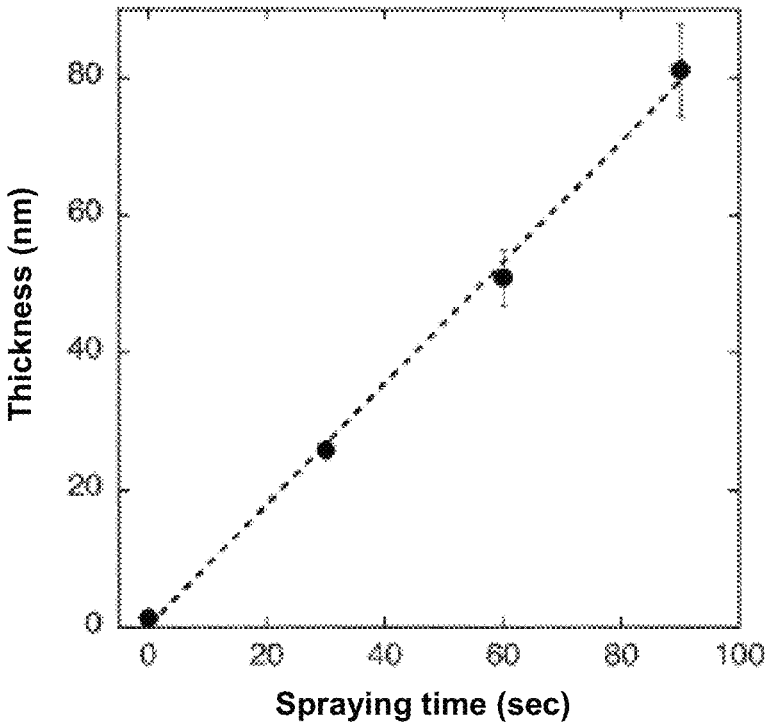

FIG. 13: Ellipsometric thicknesses of a thin layer of PAH/potassium hexacyanoferrates (III) as a function of the spraying time. The concentrations of the solutions sprayed simultaneously was 1 mg/mL of PAH and $3.10^{-2}$ mol/L for potassium hexacyanoferrate (III). The dotted line serves as guide for the eyes.

Figure 14:
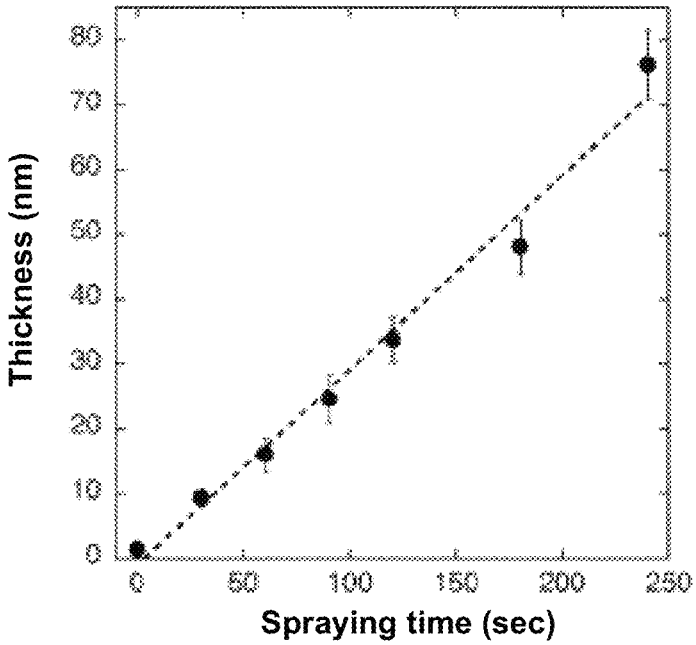

FIG. 14: Ellipsometric thicknesses of a thin layer of PAH/oxalate, obtained by simultaneous spraying of solutions of PAH (1 mg/mL) and oxalate ($10^{-1}$ mol/L), as a function of the spraying time. The dotted line serves as guide for the eyes.

Figure 15:
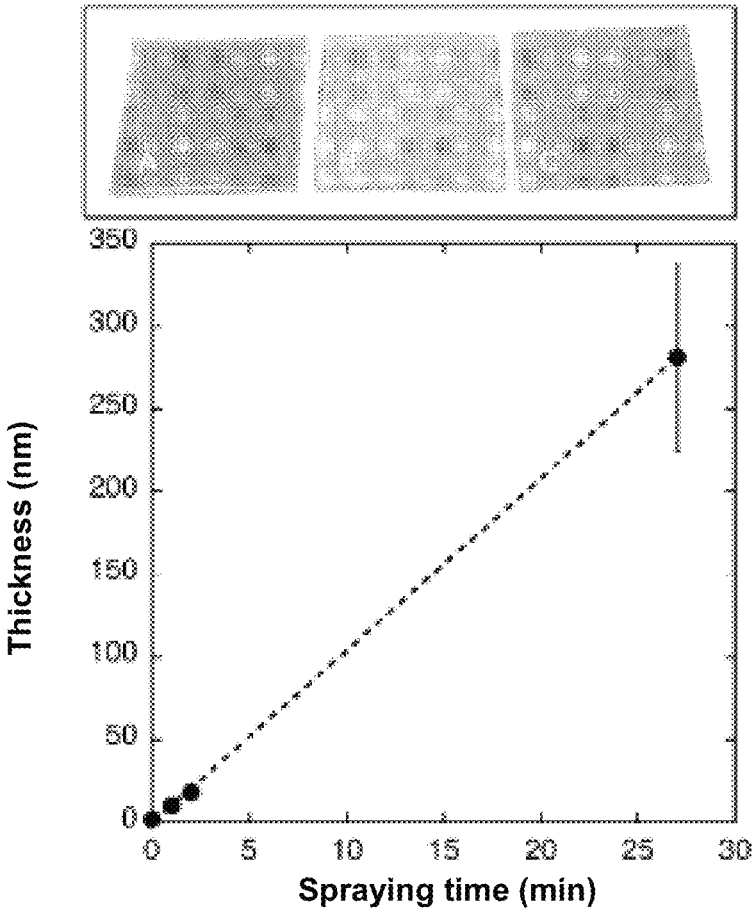

FIG. 15: Top image: optical images of thin layers of PAH/phytic acid on silicon wafers of size 40 mm×40 mm at different spraying times: A=11 minutes, B=23 minutes and C=27 minutes. Bottom image: Ellipsometric thicknesses of a thin layer of PAH (1 mg/mL) and sodium phytate ($10^{-1}$ mol/L) as a function of the spraying time. The dotted line serves as guide for the eyes.

Figure 16:
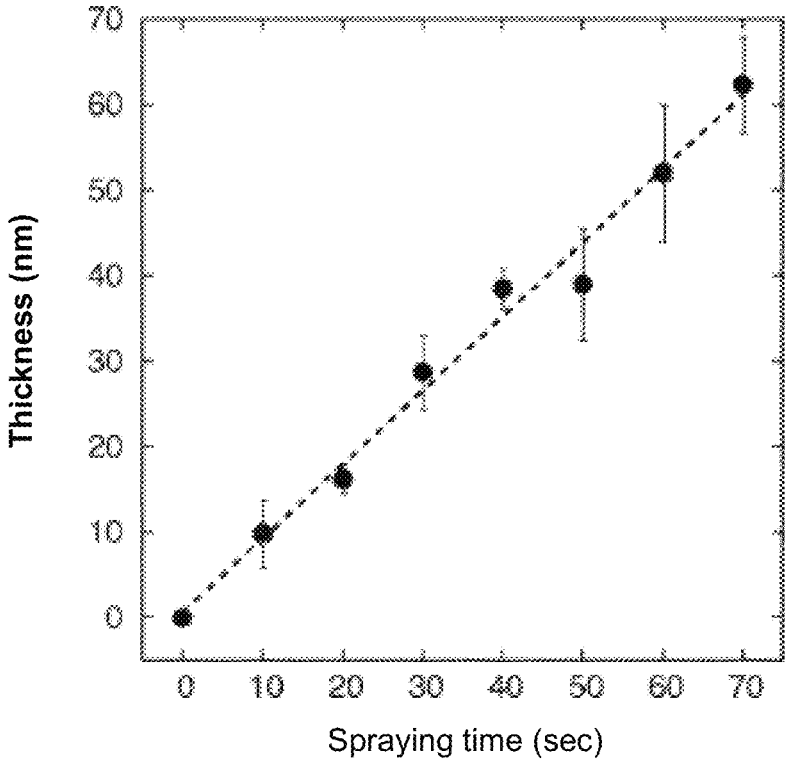

FIG. 16: Ellipsometric thicknesses of a thin layer of PAA/spermine, obtained by simultaneous spraying of solutions of spermine ($8.66.10^{-3}$ mol/L) and PAA (0.5 mg/mL) at pH 7.5, as a function of the spraying time. The dotted line serves as guide for the eyes.

Figure 17:
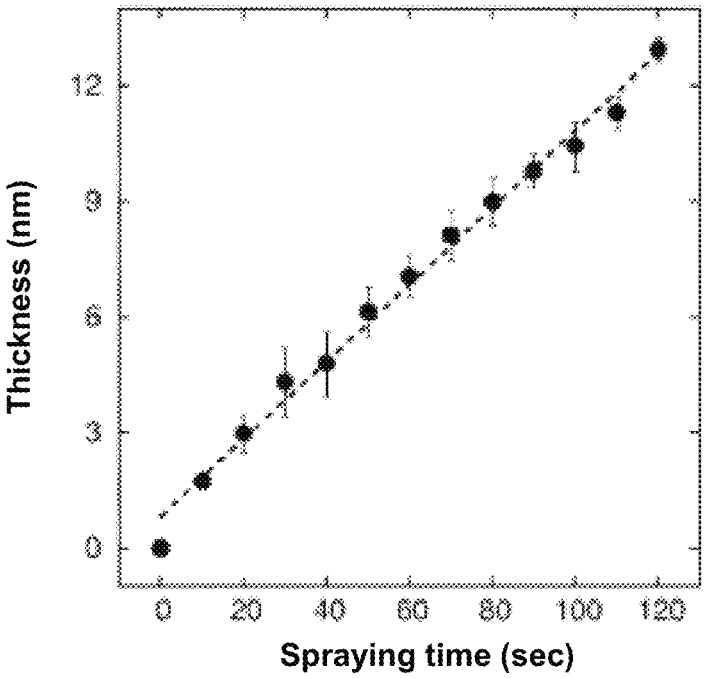

FIG. 17: Ellipsometric thicknesses of a thin layer of PAH/α-cyclodextrin sulphate, obtained by simultaneous spraying of solutions of PAH (0.5 mg/mL) and the sodium salt of α-cyclodextrin sulphate ($4.55.10^{-3}$ mol/L) at pH 7.5, as a function of the spraying time. The dotted line serves as guide for the eyes.

Figure 18:
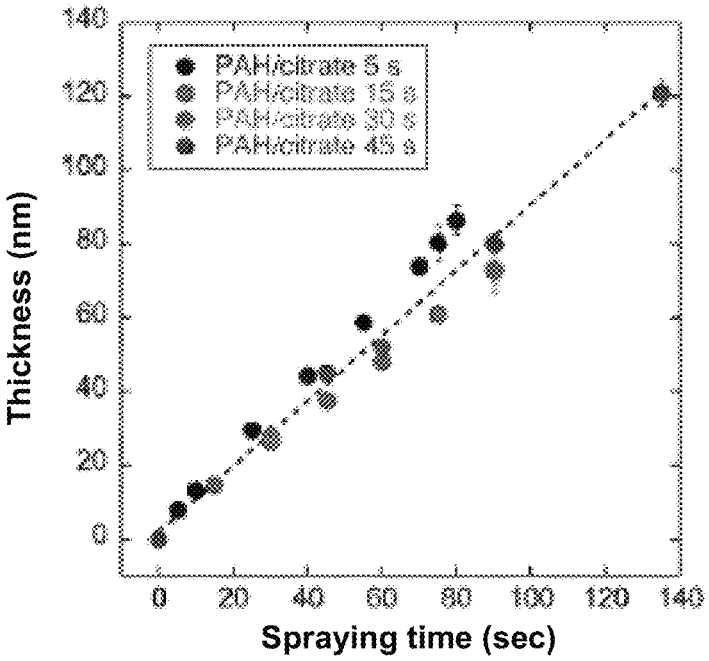

FIG. 18: Ellipsometric thicknesses of thin layers of PAH/sodium citrate, obtained by simultaneous spraying of solutions of PAH (0.5 mg/mL) and citric acid ($14.56.10^{-3}$ mol/L) at pH 7, as a function of the spraying time. The different colours represent different spraying intervals between the measurements by ellipsometry. The curve shows that sprayings carried out at different time intervals do not have a significant influence on the final thickness of the thin layer. The final thickness of the thin layer is dependent on the total spraying time. The dotted line serves as guide for the eyes.

Figure 19:
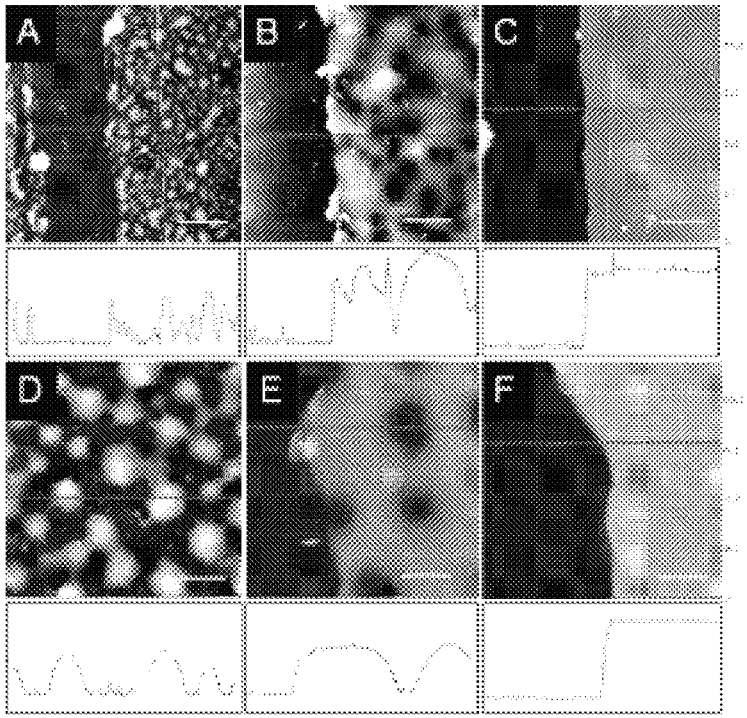

FIG. 19: The images A, B, C, D, E and F obtained by atomic force microscopy comprise two parts: the topographies (above) and the profile lines (below) of thin layers obtained by simultaneous spraying according to the present invention of: PAH/citrate (A), (B) and (C) with spraying times of 30 s, 75 s and 120 s respectively;

Poly(diallyl dimethyl ammonium chloride) (PDADMAC)/PAA (D), (E) and (F) with spraying time of 70 s, 120 s and 180 s respectively. The scanned surfaces are 12 μm×12 μm. The scale bars are 2.5 μm. The thin layers of (A), (B), (C), (E) and (F) have been scratched in order to determine specifically their height profile and their exact thickness. For the profile lines, the Y axis is comprised between 0 and 120 nm for (A), (B) and (C) and between 0 and 400 nm for (D), (E) and (F).

Figure 20:
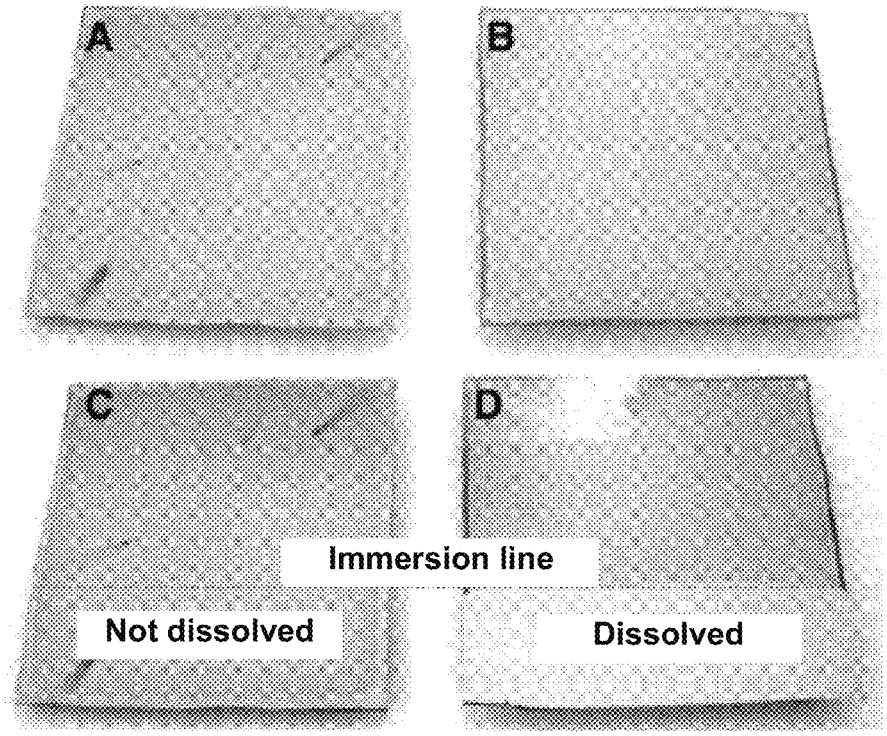

FIG. 20: The thin layers prepared by simultaneous spraying of PAH (1 mg/mL, $M_w$~15000 g/mol) and 0.02 mol/L of citrate (B, D) and a mixture of citrate and glutaraldehyde (GA) (A, C) each with final concentrations of 0.02 mol/L. A, B: thin layers before immersion in NaCl. C, D thin layers after immersion of the lower part of each wafer, in 0.5 mol/L of NaCl for 1 minute. The thin layer prepared in the absence of glutaraldehyde (D) was completely dissolved whereas the formation of the citrate/GA thin layer is not dissolved. This demonstrates a cross-linking during the spraying and the formation of the thin layer. The citrate/GA thin layers remain intact even when left in a salt solution overnight. NB: The imperfection at the top of the layer (D) is an artefact due to the handling of the wafer during its soaking in the saline solution.

Figure 21:
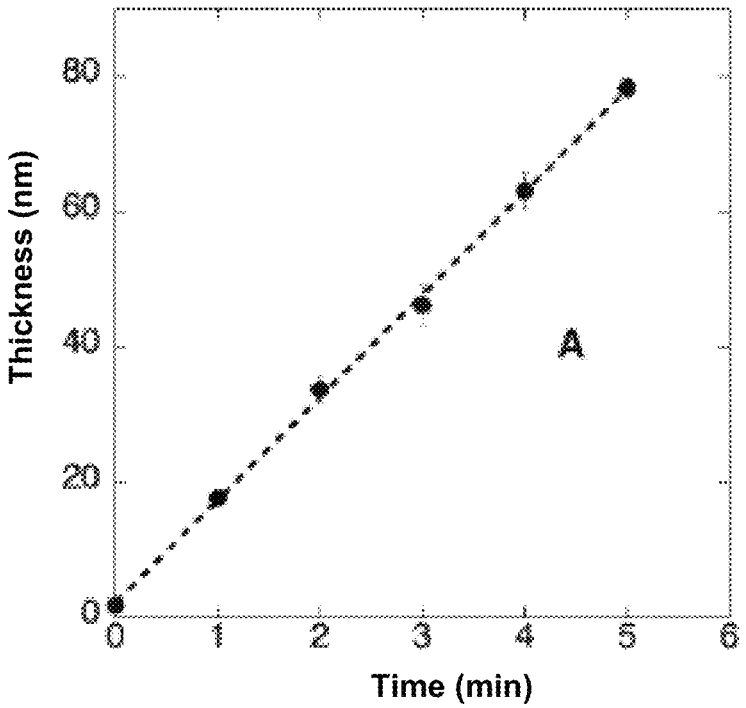

FIG. 21: Ellipsometric thicknesses of a thin layer of PAH/nanoparticles of gold/sodium citrate as a function of time. The dotted line serves as guide for the eyes. The following solutions were sprayed simultaneously: 1) PAH (1 mg/mL, $M_w$~15000 g/mol) and 2) nanoparticles of gold (12 nmol/L, average size of the nanoparticles 13 nm, nanoparticles prepared by reduction of citrate by adding 70 mL of $38.8.10^{-3}$ mol/L of a solution of sodium citrate to 700 mL of $1.10^{-3}$ mol/L $HAuCl_4$ solution).

Figure 22:
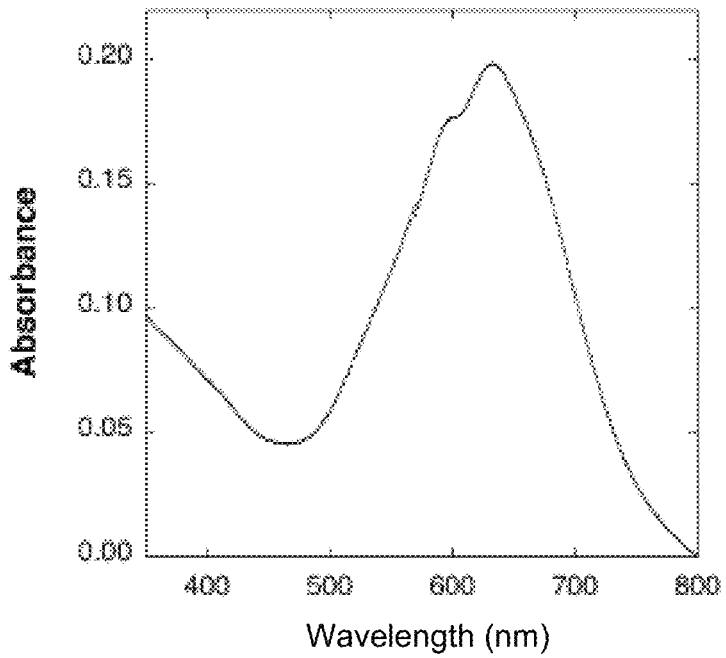

FIG. 22: UV-visible spectrum of a PAH/citrate thin layer, obtained by simultaneous spraying for 5 minutes, containing nanoparticles of gold on a glass wafer. The presence of nanoparticles of gold in the thin layer is confirmed by the strong plasmon absorption band centred at around 650 nm.

Figure 23:
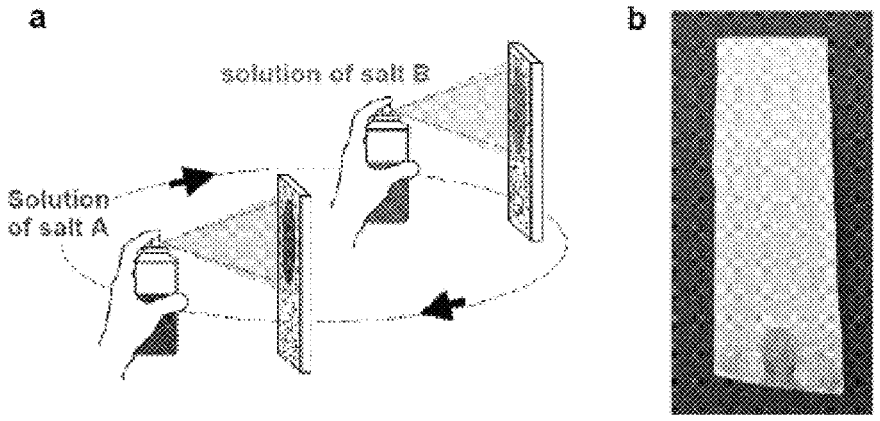

FIG. 23: *a*) Schematic representation of the system of alternate spraying according to the invention used for the deposition of purely inorganic thin layers AB from 2 complementary salts A and B. *b*) Image of a thin layer of calcium phosphate obtained after 75 spraying cycles on a silicon wafer of 1.5 cm×5.0 cm. Due to its polycrystallinity and its nanoporous morphology, the coating appears white in reflected light.

Figure 24:
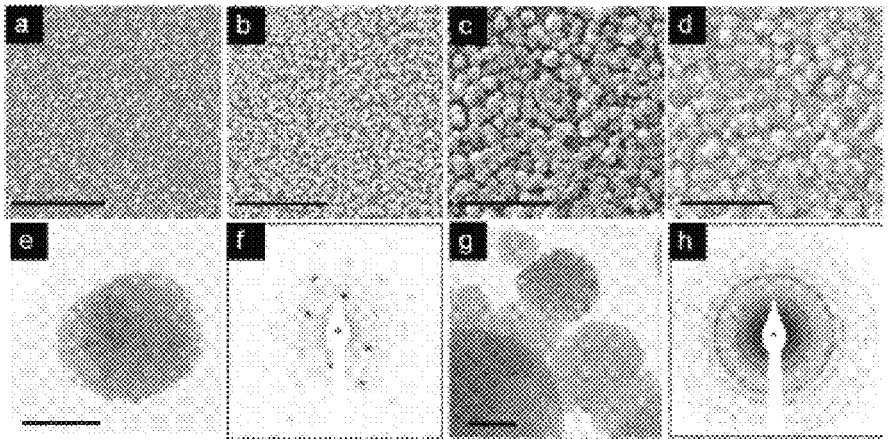

FIG. 24: *a-d*) Scanning electron microscopy micrographs showing a top view of a thin layer of $CaF_2$ obtained at different steps of the growth of the thin layer constructed by alternate spraying. The number of spraying cycles for each sample is as follows: 3 (*a*), 10 (*b*), 50 (*c*) and 200 (*d*). The scale bar represents 10 μm. *e-h*) electron micrographs and diffraction patterns were obtained by transmission electron microscopy of crystals of $CaF_2$ after 1 cycle (*e, f*) and 3 spraying cycles (*g, h*). The scale bars represent 100 nm for the image (*e*) and 200 nm for the image (*g*).

Figure 25:
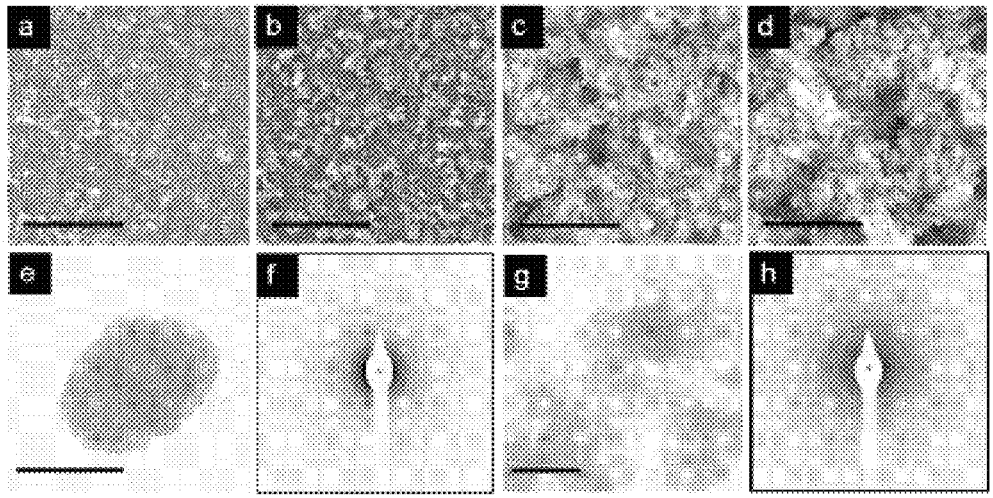

FIG. 25: *a-d*) Scanning electron microscopy micrographs showing a top view of a thin layer of $CaHPO_4$ obtained at different steps of the growth of the thin layer constructed by alternate spraying. The number of spraying cycles for each sample is as follows: 3 (*a*), obtained 10 (*b*), 50 (*c*) and 200 (*d*). The scale bar represents 10 μm. *e-h*) electron micrographs and diffraction patterns were determined by transmission electron microscopy of crystals of $CaF_2$ after 1 cycle (*e, f*) and 3 spraying cycles (*g, h*). The scale bars represent 100 nm for the image (*e*) and 200 nm for the image (*g*).

Figure 26:
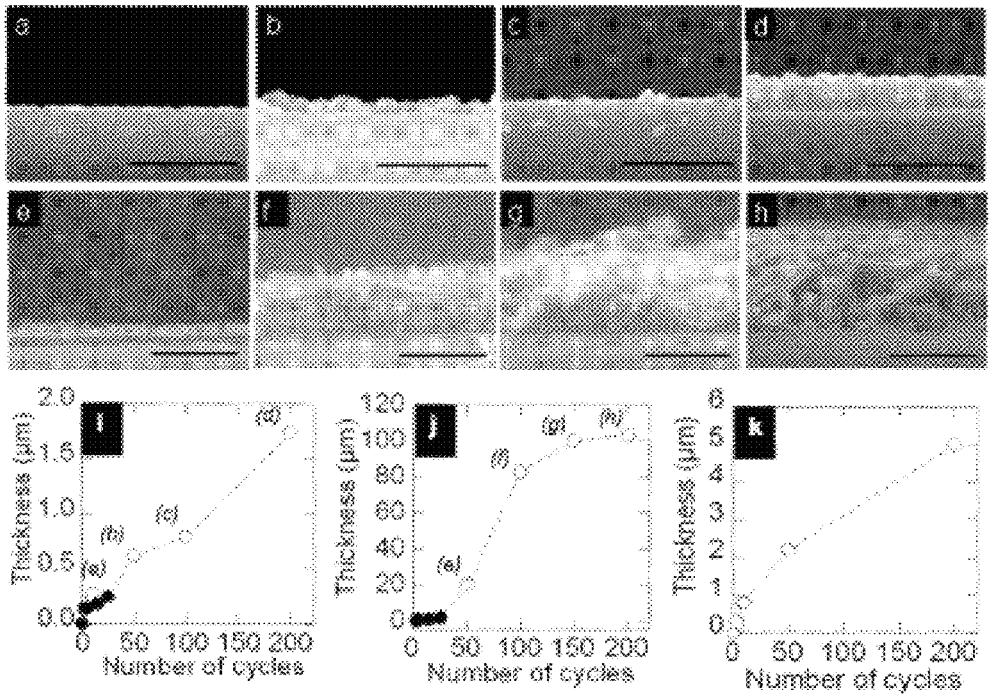

FIG. 26: Scanning electron microscopy micrographs showing a side view of a thin layer composed of $CaF_2$ (*a-d*) and $CaHPO_4$ (*e-h*) at different steps of the growth of the thin layer constructed by alternate spraying, *i-k*) Evolution of the thickness of films of $CaF_2$ (*i*), $CaHPO_4$ (*j*) and $CaC_2O_4$ (*k*) as a function of the number of spraying cycles. The thicknesses were determined both by atomic force microscopy (scraping of the coating, blue circles) and scanning electron microscopy (red circles). The number of spraying cycles for each sample is as follows: 10 (*a*), 50 (*b, e*), 100 (*c, f*), 150 (*g*) and 200 (*d, h*). The scale bars represent 5 μm for (*a-d*) and 100 μm for (*e-h*).

Figure 27:
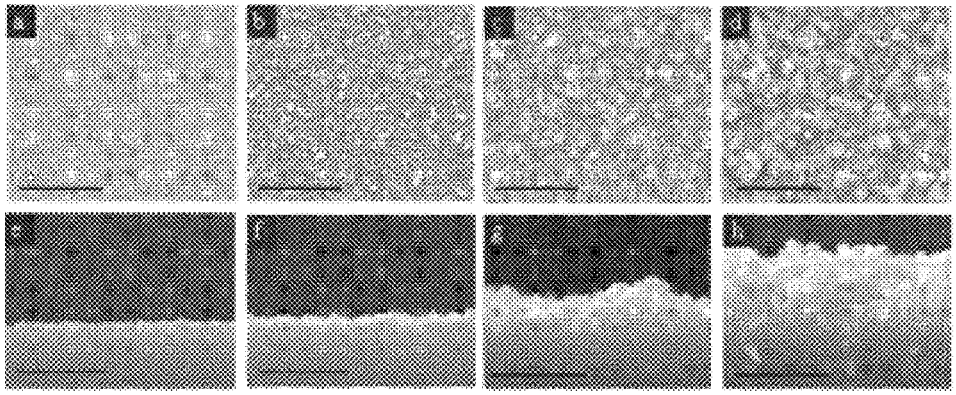

FIG. 27: Scanning electron microscopy micrographs showing a top view (*a-d*) and a transversal sectional view (*e-h*) of a thin layer composed of $CaC_2O_4$ at different steps of the growth of the thin layer constructed by alternate spraying. The number of spraying cycles for each sample is as follows: 10 (*a, e*), 50 (*b, f*), 100 (*c, g*) and 200 (*d, h*). The scale bars represent 10 m for the top view and 5 μm for the transversal sectional view.

Figure 28:
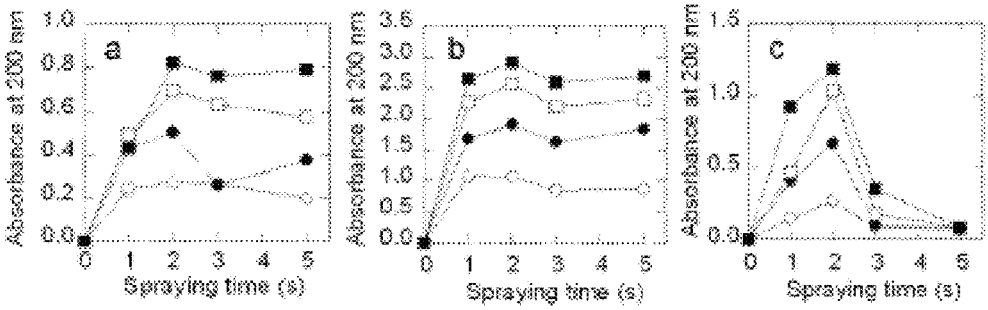

FIG. 28: Evolution of the absorbance measured at 200 nm as a function of the spraying time for thin layers of $CaF_2$ (*a*), $CaC_2O_4$ (*b*) and $CaHPO_4$ (*c*) after 5 (○), 10 (●), 15 (□) and 20 (■)cycles. The curves show that in two cases (*a, b*), there are curves showing a plateau and in one case (*c*), there is a curve showing a maximum. This indicates that it is necessary to optimise the spraying time as a function of the reactive partners to be capable of constructing a thin layer (case (*a*) and (*b*): above a spraying, time of 1-2 seconds the construction is independent of the spraying time; and case (*c*): the construction depends on the spraying time, the thin layer dissolves beyond the maximum spraying time).

Figure 29:
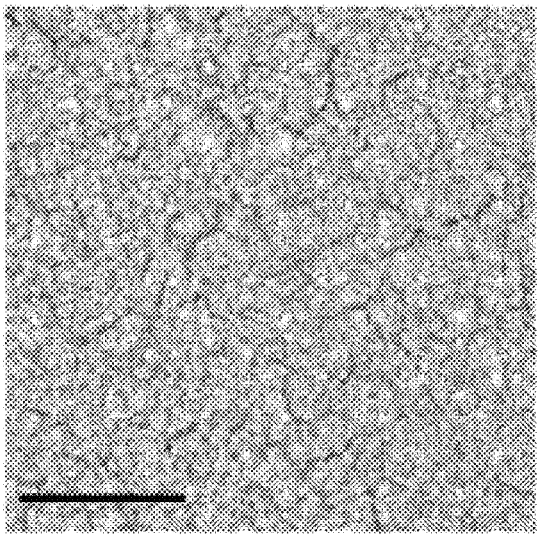

FIG. 29: Scanning electron micrograph showing a top view of a film of $CaHPO_4$ after 100 spraying cycles. The scale bar represents 100 μm.

Figure 30:
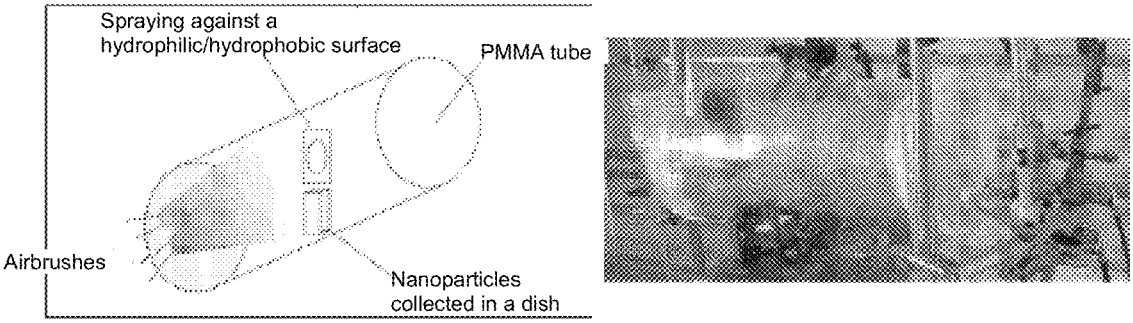

FIG. 30 is a schematic representation (on the left) and a photograph (on the right) of the enclosure used to work under inert atmosphere.

The present invention is described in more detail with the aid of the following examples, which are given for illustration purposes and to which the invention is not limited.

EXAMPLES

The present invention has already been used to produce organic, inorganic, mineral, hybrid thin layers or those containing nanoparticles. For all these cases, it has been possible to manufacture very homogeneous thin layers for which the thicknesses have been able to be varied as a function of the spraying time (simultaneous spraying) or as a function of the number of spraying cycles (alternate spraying).

The reagents used were obtained from the firms Sigma Aldrich, Fluka, Carlo Erba Reagents and Merck.

The wafers of glass, quartz, and silicon were obtained from the firms Fisher Bioblock Scientific (France), WaferNet Inc. (USA) and Thuet B. (France).

Ultrapure water, having a resistivity of 18.2 MΩ·cm, was obtained from osmosis water obtained with a Milli-Q Gradient system from the firm Millipore. The water was used directly after purification.

The size and the electron diffraction of the nanocrystals were determined by transmission electron microscopy (TEM, Phillips, CM200) used in "low-dose" mode at an acceleration voltage of 200 kv, equipped with a digital camera (Gatan, Orius 1000). The resolution of the microscope was 0.2 nm. The acquisition and the processing of the images was carried out with "Digitalmicrograph software". The scanning electron microscope used, if applicable, in the examples below, was "ESEM, FEI, Quanta 400). The Z sections of the samples were obtained by breaking the glass substrates coated with a thin layer.

The UV-visible absorbance spectra of the examples below were performed on a device of type: Varian Cary 500 Scan. The variations in intensity of the base line are due to the light scattering by the crystals within the inorganic thin layers themselves, which makes it possible to monitor the evolution of the growth of said thin layers.

The ellipsometry measurement examples below were performed with an apparatus of type "PLASMOS SD 2300" operating at a wavelength of 632 nm and at an angle of 70°. For technical reasons, all of the refractive indexes of the thin layers have been presumed constant and equal to n=1.465. The thickness data are all derived from an average of 10 measurements taken at different places of the coated wafer.

The atomic force microscopy measurements were performed with an apparatus of type "Veeco Multimode Nanoscope IIIA (Digital Instrument)".

Example 1

Formulation of the Technical Characteristics of the Simultaneous Spraying for Producing a Coating Preparation of the Substrate The silicon wafers were cleaned by immersing them successively for one hour in a mixture of methanol and hydrochloric acid (50:50) and one hour in a concentrated sulphuric acid solution, then by thorough rinsing in ultra-pure water before use.

The wafers of glass and quartz were cleaned with diluted solutions of Hellmanex heated to boiling (100° C.) for 15 minutes, and thoroughly rinsed with ultra-pure water or in the same manner as the wafers of silicon.

Technical Characteristics of the Simultaneous Spraying:

For the coating obtained by simultaneous spraying, different airbrush models were used:

- model A480 of the firm Aztek, USA,
- model 280004 of the firm Sedip, France,
- model VL of the firm Paasche, USA.
- nozzle of the firm Spraying Systems Co, USA
- the pressurised gas was produced by different means:
- compressed air on the laboratory internal network,
- arrival of nitrogen on the laboratory internal network, or
- direct compression of air by compressor (model 210023 of the firm SEDIP, France), with a fixed pressure in the majority of cases between 1 and 3 bars.

The solutions were sprayed in a simultaneous manner on the substrates with a circular or vertical movement, in order to improve the homogeneity.

Different liquid flow rates and gas pressures were used according to the different systems:

- for polymer-polymer systems, the flow rate of solution was 13±2 mL/min and 19±2 mL/min respectively for the positively or negatively charged compounds, with a gas pressure of 2 bars,
- for inorganic coatings, the flow rates of the solutions were 12±1 mL/min for the two solutions respectively, with a gas pressure of 2 bars,
- for "polymers-small molecules" systems (small molecules is taken to mean molecules of molecular weights below 2000 $g \cdot mol^{-1}$) the solution flow rates of the two compounds was 6±1 mL/min with a gas pressure of 3 bars in the case of airbrushes of the Aztek firm, and 13±2 mL/min and 19±2 mL/min for the compounds charged positively and negatively respectively with a gas pressure at 2 bars, in the case of airbrushes of the firm Paasche.

For the systems with 3 compounds, the flow rates of solutions of nanoparticles of gold (AuNPs), citrate with glutaraldehyde, citrate, were 6±1 mL/min and the flow of poly-(allylamine) hydrochloride (PAH) was 3±1 mL/min, with a gas pressure at 3 bars.

The spraying steps were followed by a step of rinsing the wafers for 5 or 10 seconds by spraying "Milli-Q" water (pH 5.9) with a cylinder of compressed air of Air-Boy® type, from the firm Roth. The coated substrates were then dried with a flow of nitrogen at a pressure of 2 bars.

Example 2

Diversity of Applications of the Spraying Method According to the Invention

The technique of simultaneous spraying according to the invention may for example be applied to the spraying of inorganic/inorganic (case A), polymer/polymer (case B), polyelectrolytes/small oligo-ions (case C) and polyelectrolytes/nanoparticles (case D) solutions.

The covering of a silicon wafer by each of these couples was thus obtained by the present invention (see FIG. 2).

Example of application of case A: NaF ($2.10^{-2}$ mol/L) and $CaCl_2$ ($1.10^{-2}$ mol/L).

Example of application of case B: polyethylene-oxide (0.5 mg/mL, $M_w$~50,000 g/mol, with stabilisers) and polyacrylic acid (0.5 mg/mL, $M_w$~100,000, 35% by weight in water) at pH 2.

Example of application of case C: PAH (1 mg/mL, Mn=56000 g/mol) and sodium citrate (0.02 mol/L).

Example of application of case D: PAH (1 mg/mL, Mn=15000 g/mol) and nanoparticles of gold (12 nmol/L)

The wafers (A, B, C, D) of FIG. 2 were obtained on silicon wafers (40 mm×40 mm) in slow rotation (10 and 1250 rpm) to improve the homogeneity of the films/thin layers in each case. A rapid rotation of the supports is also possible (tested up to 15000 rpm). The colour nuances were obtained by optical interference indicating the quality and the homogeneity of the thin layers obtained.

Example 3

Production of Inorganic Thin Layers by Simultaneous Spraying

For inorganic thin layers, it is important that the product obtained is less soluble in the reaction medium than the sprayed compounds (Table 1).

TABLE 1

Solubility of inorganic compounds taken from the *Handbook of Chemistry and Physics*, 57th Edition, CRC Press, 1976-1977.

| Inorganic compounds | Solubility [g/100 mL] | Ionic solubility [M] |
|---|---|---|
| $CaCl_2$ | 74.5 (20° C.) | $[Ca^{2+}] = 6.7$ |
| NaF | 4.13 (18° C.) | $[F^-] = 9.8$ |
| $CaF_2$ | $1.6 \times 10^{-3}$ (18° C.) | $[Ca^{2+}] = 2.05 \times 10^{-4}$ $[F^-] = 4.10 \times 10^{-4}$ |
| $CaCl_2$ | 74.5 (20° C.) | $[Ca^{2+}] = 6.7$ |
| $Na_2C_2O_4$ | 3.7 (20° C.) | $[C_2O_4^{2-}] = 2.76 \times 10^{-1}$ |
| $CaC_2O_4$ | $6.7 \times 10^{-4}$ (18° C.) | $[Ca^{2+}] = 5.23 \times 10^{-5}$ $[C_2O_4^{2-}] = 5.23 \times 10^{-5}$ |
| $Ca(NO_3)_2, 4H_2O$ | 121.2 (18° C.) | $[Ca^{2+}] = 5.1$ |
| $(NH_4)_2HPO_4$ | 57.5 (10° C.) | $[HPO_4^{2-}] = 4.36$ $[Ca^{2+}] = 1.83 \times 10^{-3}$ |
| $CaHPO_4, 2H_2O$ | $3.16 \times 10^{-2}$ (38° C.) | $[HPO_4^{2-}] = 1.83 \times 10^{-3}$ |

For example, the method according to the invention lends itself well to the production of a thin layer of calcium fluoride according to the following equation:

$$CaCl_2\ (aq.) + 2\ NaF\ (aq.) \rightarrow CaF_2\ (\text{thin layer}) + 2NaCl\ (aq.)$$

Thus two solutions, one of calcium chloride ($1.10^{-2}$ M) and the other of sodium fluoride ($2.10^{-2}$ M), were simultaneously sprayed on a surface oriented in a vertical manner, in a ratio of 1:1 by volume. This results in the formation of a solution containing calcium fluoride in much higher concentration at the limit point of solubility of the $CaF_2$ of $2.10^{-4}$ M. After drying, the thickness and the morphology of the thin layer were determined at different steps of growth by atomic force microscopy and by scanning electron microscopy, showing a good correlation of the thickness with the spraying time (see FIGS. 3, 4 and 5). A nucleation and a continuous growth are observed up to the formation of a dense layer of $CaF_2$. The polycrystalline nature of the resulting deposition was confirmed by transmission electron diffraction (Table 2).

TABLE 2

Assignment of experimental values of $d_{h,k,l}$ obtained from transmission electron diffraction data for samples of incomplete coatings of $CaF_2$ after 1 second of spraying. The comparison with literature values clearly shows that the composition of the thin layer is $CaF_2$.

| hkl | d(hkl) theoretical (nm) | d'hkl) experimental (nm) |
|---|---|---|
| 111 | 0.321 | 0.315 |
| 200 | 0.277 | 0.273 |
| 220 | 0.195 | 0.193 |
| 311 | 0.167 | 0.165 |
| 222 | 0.159 | 0.158 |
| 400 | 0.139 | 0.137 |
| 422 | 0.113 | 0.112 |
| 333 | 0.107 | 0.105 |
| 440 | 0.097 | 0.097 |

The accumulation of $CaF_2$ then continues perpendicularly to the substrate and the thickness of the thin layer grows regularly with the spraying time.

The method according to the invention has also been tested and approved in producing inorganic thin layers of calcium hydrogen phosphate ($CaHPO_4$), calcium oxalate ($CaC_2O_4$), iron hydrogen phosphate ($Fe_2(HPO_4)_3$), Prussian blue ($Fe_4[Fe(CN)_6]_3$) and silver chloride (AgCl). The various results obtained (see FIGS. 6-11) corroborate the conclusions made with calcium fluoride.

Example 4

Production of an Inorganic Thin Layer by Alternate Spraying

To produce a thin layer of calcium fluoride, calcium phosphate or calcium oxalate, it is also possible to spray alternatively the solution which contains the calcium salt (A) and the solution containing the complementary salt (B) (FIG. 23).

Electron diffraction analysis shows that the 2 approaches lead to the formation of the same $CaF_2$.

The two approaches give similar results despite a different mechanism of nucleation and growth (excess of one compound with respect to the other at each step for the alternate spraying).

Advantage of alternate spraying: more homogeneous thin layer.

Advantage of simultaneous spraying: time savings.

As in the case of simultaneous spraying, the construction of an inorganic thin layer by alternate spraying is based on the non negligible difference of solubility of the reactive partners compared to that of the inorganic solid product that forms a thin layer on the surface following local supersaturation (Table 1). The latter (excess of A/B or excess of B/A), taking place at each spraying in the liquid film close to the surface, leads to a nucleation of germs that are going to attach themselves to the surface and enable the thin layer to grow.

Practically, the process consists in spraying the compound A for 2 seconds then the compound B for 2 seconds and this spraying cycle may be repeated n times to form the thin layer $(A/B)_n$. For example, the production of a thin layer of calcium fluoride is carried out by simultaneous spraying of solutions of calcium chloride ($2.10^{-2}$ M) and sodium fluoride ($2.10^{-2}$ M) using a manually actuated pump sprayer (Roth, flow rate 0.6 mL/s). Scanning electron microscopy has revealed that the growth of the thin layer starts with the formation of nanocrystals which increase in number and in size with the number of spraying cycles up to completely covering the surface (FIG. 24 *a-d*). Then, the growth of the thin layer takes place in the direction normal to the layer. Transmission electron microscopy and electron diffraction have shown that the smallest crystals, monocrystalline, become polycrystalline (FIG. 24 *e-h*). In the case of $CaF_2$, dense polycrystalline thin layers are obtained.

Alternate spraying was also tested and approved in producing inorganic thin layers of calcium hydrogen phosphate ($CaHPO_4$) and calcium oxalate ($CaC_2O_4$). However, in these two cases, the growth of the thin layer takes place by nucleation of small additional polycrystalline crystals rather than by growth of crystals (FIGS. 25 and 27). Unlike $CaF_2$, thin polycrystalline porous layers are obtained in the case of $CaHPO_4$ and $CaC_2O_4$.

The thickness of these different thin layers was determined by atomic force microscopy (below 200 nm) and scanning electron microscopy (up to a scale of 100 mm) (FIG. 26) and estimated by UV-visible spectroscopy (FIG. 28). This latter technique made it possible to show the importance of the spraying time on the construction of inorganic thin layers.

The homogeneity of these thin layers at large scale is illustrated in FIG. 29 for a $CaHPO_4$ coating.

Example 5

Thin Layers of a Polymer/Polymer Complex Interacting by Hydrogen Bonding Constructed by Simultaneous Spraying Another sufficiently strong interaction for the preparation of thin layers according to the invention is hydrogen bonding, as illustrated by the regular growth of poly(acrylic) acid (PAA) and poly(ethylene-oxide)(PEO) systems (FIG. 12). In solution, this system shows a strong complexation below a pH value of around 3.5. The thin layers obtained by simultaneous spraying at pH=2, according to the method of the present invention in this particular embodiment, are easily dissolved at pH values=5.

The properties of the layers may be controlled by the molar mass of the constituents.

Example 6

Thin Layers of Polyelectrolyte/Small Oligo-Ion Complexes by Simultaneous Spraying Nevertheless, in a surprising manner, the spraying of polyelectrolytes with a small oligo-ion multicharged in an opposite manner can lead to the formation of a thin layer. For such systems, the PAH and sodium citrate model may be presented. It is interesting to note that by the conventional layer by layer deposition technique (technique known as "LbL"), it is impossible to obtain thin layers with this model. Thin layers of other compounds (PAA/spermine, PAH/sodium salt of phytic acid, PAH/sodium salt of α-cyclodextrin sulphate, PAH/sodium oxalate, PAH/potassium hexacyanoferrate (III), see FIGS. 13-18) were obtained with success using the method of simultaneous spraying according to the present invention. In all cases, the growth of the thin layer is regular as a function of the spraying time.

In the case of PAH/sodium citrate, the deposition of the thin layer/film and the mechanism of formation of the thin layer have been able to be monitored by atomic force microscopy (FIG. 19). During the initial steps of accumulation, the thin layer is rather inhomogeneous and forms objects in the form of drops in a disparate manner, which nevertheless increase in size and in number as spraying progresses (FIG. 19A). With an additional spraying, these structures join up with each other through lateral contact, forming a thin layer with holes (FIG. 19 B) and finally a continuous very regular thin layer is obtained (FIG. 19 C). A similar development of the morphologies as a function of the spraying time has been observed for polyanion/polycation systems, such as poly(N, N-dimethyl-N,N-diallyl ammonium) chloride with PAA (poly(acrylic) acid), (FIG. 19 D-F).

The thin layers obtained by simultaneous spraying of PAH and sodium citrate dissolve rapidly when they are immersed in NaCl solutions with ionic strengths above 0.15 M, opening possibilities for use as materials or triggered release systems. The rapid degradation of such thin layers may easily be avoided and controlled by cross-linking; for example by heating to 130° C. for several hours in an oven or for several 20 minutes using a heat gun. This enables a partial cross-linking by formation of amide bonds by reaction of the carboxylic acid groups of the citrates with the amine groups of PAH, in a similar manner to the case described with the thin layers obtained by the technique of "LbL" type.

The technique of simultaneous spraying according to the method of the present invention enables a chemical cross-linking in situ of thin layers by adding compounds that react with the sprayed solutions. In the case of PAH/citrate thin layers, the addition of glutaraldehyde to the solution of citrate leads to the development of a network of covalent bonds by the formation of a Schiff base. Such coatings do not dissolve in a solution of 0.5 mol/L NaCl, even over a long time period (see FIG. 20).

In an interesting manner, the simultaneous spraying of PAH and glutaraldehyde in the absence of citrate did not make it possible to succeed in the formation of a thin layer.

Example 7

Thin Layers of Polyelectrolyte/Nanoparticle Complexes by Simultaneous Spraying

Different functionalities, apart from reactivity, may also be incorporated in the thin layers obtained by simultaneous spraying. For example, nanoparticles of gold ($1^{st}$ compound) stabilised with citrate ($2^{nd}$ compound), sprayed in a simultaneous manner with PAH ($3^{rd}$ compound), results in very homogeneous thin layers (FIG. 1D), having a regular growth as for all the other examples presented above. In addition, the presence of nanoparticles of gold provides the advantage of monitoring the formation of the thin layer by following the change in the plasmon band (see FIGS. 21 and 22).

The facility and the large spectrum of applications of the method of formation of thin layers by simultaneous spraying of the present invention are proven by the different systems described above, and are so without in-depth studies of the parameters and variables involved in spraying technologies. The above experiments have shown that the growth or the morphologies of thin layers depend on the spraying time. It may be foreseen that other parameters such as the concentrations of the solutions, the type of nozzle used, the spraying distance, etc., can make it possible to change the characteristics of the thin layers obtained. In addition these parameters are very easily and rapidly adjustable by the method of the present invention, once again proving the ease of adaptation and the robustness of said method. In addition, the method of simultaneous spraying with two nozzles may be extended to a method known as "multi-nozzle" (greater than 2), enabling the consecutive application of 2 different pairs of complementary reactive partners by simultaneous spraying, making it possible to easily produce stratified thin layers thus incorporating different materials and thus different functionalities (sandwich type thin layers). Furthermore, the combination of several deposition methods, for example LbL and simultaneous spraying, also makes it possible to obtain stratified multimaterial layers.

The invention claimed is:

1. Method for the continuous deposition on a substrate of a thin homogeneous layer of a product obtained from at least two reactive partners, characterised in that it involves the:

simultaneous continuous spraying, or alternate continuous spraying of two reactive partners of inorganic nature, on said substrate, using separate sprayers, of at least two liquids each containing one of the reactive partners or a mixture thereof, such that clouds of droplets are produced containing droplets of micro and nanometric size which interact together mainly at the level of a liquid film of controlled thickness comprised between 0.1 μm and 100 μm that forms on contact with a free surface of the substrate, and wherein the thickness of said thin homogeneous layer of product, formed from said liquid film, is mainly controlled by the duration of said continuous spraying, except where two reactive partners are of polymer nature, interact by electrostatic interactions, and are deposited by simultaneous spraying;

wherein the sprayers comprise nozzles arranged so that spraying jets of the liquids from the nozzles arrive at the surface of the substrate along a direction essentially orthogonal with respect to the latter.

2. Method according to claim 1, characterised in that one at least of the reactive partners is of complementary inorganic nature.

3. Method according to claim 1, characterised in that said reactive partners lead to the product to be deposited by chemical reaction.

4. Method according to claim 1, characterised in that said reactive partners lead to the product to be deposited by physical or physical-chemical interaction.

5. Method according to claim 1, characterised in that the reactive partners include a mineral, inorganic, organic or nanoparticle type product, a solvent of said product and a non-solvent of said product.

6. Method according to claim 1, characterised in that the spraying of the different liquids against said substrate is carried out in an alternate manner.

7. Method according to claim 1, characterised in that the spraying of the different liquids against said substrate is carried out in a simultaneous manner.

8. Method according to claim 1, characterised in that the reactive partners are aqueous solutions of complementary inorganic cations and anions.

9. Method according claim 1, characterised in that one of the reactive partners is a small organic molecule, a polymer or a nanoparticle.

10. Method according to claim 1, characterised in that the surface of the substrate and the spraying nozzles are moveable in relation with each other, so as to ensure the deposition of the thin layer on all of the substrate and to improve the homogeneity of the thin layer.

11. Method for the continuous deposition on a substrate of a thin homogeneous layer of a product obtained from at least two reactive partners, characterised in that it involves the:

simultaneous continuous spraying, or alternate continuous spraying of two reactive partners of inorganic nature, on said substrate, using separate sprayers, of at least two liquids each containing one of the reactive partners or a mixture thereof, such that clouds of droplets are produced containing droplets of micro and nanometric size which interact together mainly at the level of a liquid film of controlled thickness comprised between 0.1 μm and 100 μm that forms on contact with a free surface of the substrate, and wherein the thickness of said thin homogeneous layer of product, formed from said liquid film, is mainly controlled by the duration of said continuous spraying, except where two reactive partners are of polymer nature, interact by electrostatic interactions, and are deposited by simultaneous spraying;

wherein the sprayers comprise nozzles;

wherein a screen is provided with an opening calibrated to select central parts of spraying jets from the nozzles and avoid the contamination of the surface by the edges of the jets.

12. Method according to claim 1, characterised in that a screen is interposed between the nozzle(s) and an overlapping point of the spraying jets provided with at least one opening passing alternatively in front of the spraying jets to control the collisions and interactions of sprayed droplets.

13. Method according to claim 1, characterised in that the solubility of the material of the thin layer deposited is lower than the solubility of the reactive partners in the liquid spraying solutions.

14. Method according to claim 1, characterised in that the interaction between the reactive partners is controlled by determination of one at least of the following adjustment parameters:

concentration of the reactive partners in each liquid and viscosity of each of the spraying liquids containing the reactive partners;

composition and nature of the solvent present in each of the liquids sprayed;

temperature of the liquids sprayed;

dimension, density, speed and polydispersity of the droplets as a function of the geometry and the nature of the spraying nozzles;

variation of the angles at the tip of the dispersion cones of the spraying jets;

distance between the nozzles and the surface of the substrate to coat;

slope of said surface with respect to the main axis of the spraying jets;

flow rate of the spraying jets of the different liquids;

flow rate of the carrier gas used for the sprayings;

nature, temperature, flow rate and/or pressure of the carrier gas used for the sprayings;

nature of the solid support.

15. Method according to claim 1, characterised in that, prior to the deposition of said thin layer, the surface of the substrate to coat is rendered adhesive, by adsorption of PEI, by surface nucleation or by mineralisation of said substrate.

16. Method according to claim 1, characterised in that it is used for depositing a thin layer of different crystals selected from calcium phosphate, calcium fluoride, calcium oxalate, Prussian blue, silver chloride, iron phosphate, copper sulphide (CuS), zinc sulphide (ZnS), cadmium sulphide, indium sulphide, tin sulphide, lead sulphide, arsenic sulphide, antimony sulphide, molybdenum disulphide, manganese sulphide, iron sulphide (FeS2), cobalt sulphide, nickel sulphide and lanthanum sulphide, copper selenide (Cu2Se), silver selenide, zinc selenide, antimony selenide, indium selenide, cadmium selenide, bismuth selenide, lanthanum selenide, copper tellurate, cadmium tellurate, indium tellurate, lanthanum tellurate, copper oxide, zinc oxide, manganese oxide, cerium oxide, copper and indium sulphide, cadmium and zinc sulphide, cadmium and indium sulphide, the composites zinc sulphide/bismuth sulphide, bismuth selenide/antimony, and selenide.

17. Method according to claim 1, characterised in that the substrate is a bio-material.

18. Method according to claim 1, characterised in that the thin layer deposited moreover comprises a substance of interest selected from antibiotics, anti-inflammatory agents, antibacterial agents, anticancer agents, DNA, RNA, and plasmids.

19. Method according to claim 1, characterised in that the thin layer deposited further comprises a substance used in catalysis, in optics, or in optoelectronics, or has magnetic properties.

20. Method for the continuous deposition on a substrate of a thin homogeneous layer of a product obtained from at least two reactive partners, characterised in that it involves the:

simultaneous continuous spraying, or alternate continuous spraying of two reactive partners of inorganic nature, on said substrate, using separate sprayers comprising nozzles, of at least two liquids each containing one of the reactive partners or a mixture thereof, such that clouds of droplets are produced containing droplets of micro and nanometric size which interact together mainly at the level of a liquid film of controlled thickness comprised between 0.1 μm and 100 μm that forms on contact with a free surface of the substrate, and wherein the thickness of said thin homogeneous layer of product, formed from said liquid film, is mainly controlled by the duration of said continuous spraying, except where two reactive partners are of polymer nature, interact by electrostatic interactions, and are deposited by simultaneous spraying;

wherein the sprayers comprise nozzles;

wherein a screen is interposed between the nozzle(s) and an overlapping point of spraying jets from the nozzles provided with at least one opening passing alternatively in front of the spraying jets to control the collisions and interactions of sprayed droplets.

* * * * *